US009346258B2

(12) United States Patent
DeMoore et al.

(10) Patent No.: US 9,346,258 B2
(45) Date of Patent: May 24, 2016

(54) METHOD FOR CLEANING ANTI-MARKING JACKETS

(71) Applicant: PRINTING RESEARCH, INC., Dallas, TX (US)

(72) Inventors: Howard W. DeMoore, Dallas, TX (US); Arnold Cooper, Allen, TX (US); David Dean Douglas, Garland, TX (US); W. Scott Brown, Dallas, TX (US); Joey V. Le, Arlington, TX (US)

(73) Assignee: PRINTING RESEARCH, Inc., Dallas, TX (US)

( * ) Notice: Subject to any disclaimer, the term of this patent is extended or adjusted under 35 U.S.C. 154(b) by 0 days.

(21) Appl. No.: 14/580,089

(22) Filed: Dec. 22, 2014

(65) Prior Publication Data

US 2015/0101501 A1 Apr. 16, 2015

Related U.S. Application Data

(63) Continuation-in-part of application No. 13/462,431, filed on May 2, 2012, now abandoned.

(51) Int. Cl.

| | |
|---|---|
| ***B41F 35/00*** | (2006.01) |
| ***B41F 30/04*** | (2006.01) |
| ***B41F 22/00*** | (2006.01) |

(52) U.S. Cl.

CPC ..... *B41F 30/04* (2013.01); *B41F 22/00* (2013.01); *B41F 22/005* (2013.01); *B41F 35/00* (2013.01); *B41F 35/006* (2013.01); *B41P 2235/242* (2013.01); *B41P 2235/244* (2013.01); *B41P 2235/26* (2013.01); *B41P 2235/40* (2013.01)

(58) Field of Classification Search

CPC ..... B41F 35/00; B41F 35/006; B41F 22/00; B41F 30/04; B41F 33/0036; B41F 35/06; B41P 2235/40; B41P 2235/26; B41P 2235/10

See application file for complete search history.

(56) References Cited

U.S. PATENT DOCUMENTS

| | | | | |
|---|---|---|---|---|
| 5,009,161 | A * | 4/1991 | Wirz | B41F 35/00 101/423 |
| 5,020,433 | A * | 6/1991 | Jeschke | B41F 35/02 101/423 |
| 8,047,089 | B2 * | 11/2011 | Berti | G01N 33/34 73/866 |
| 2003/0015111 | A1 * | 1/2003 | Rizika | B32B 5/18 101/416.1 |
| 2005/0061182 | A1 * | 3/2005 | Ebina | B41F 35/00 101/425 |
| 2012/0201587 | A1 * | 8/2012 | Kato | B41F 33/0036 400/76 |

* cited by examiner

*Primary Examiner* — Jennifer Simmons

(57) ABSTRACT

A removable flexible jacket for use in a printing press having a transfer cylinder for transferring a freshly printed substrate comprises a sheet of woven fabric, a beaded film sheet coupled to the sheet of woven fabric, and an image disposed between the sheet of woven fabric and the beaded film sheet. The image is visible through the beaded film sheet, and wherein the image divides at least a portion of a surface of the beaded film sheet into a plurality of zones.

18 Claims, 14 Drawing Sheets

METHOD FOR CLEANING ANTI-MARKING JACKETS

CROSS-REFERENCE TO RELATED APPLICATIONS

This application is a continuation-in-part of U.S. patent application Ser. No. 13/462,431, filed on May 2, 2012 and entitled "Beaded Partially Coated Anti-Marking Jackets," which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the operation of a rotary offset printing press, freshly printed substrates, such as sheets or web material, are guided by transfer cylinders or the like from one printing unit to another, and then they are delivered to a sheet stacker or to a sheet folder/cutter unit, respectively. As used herein, the term "transfer cylinder" includes delivery cylinders, transfer rollers, support rollers, support cylinders, delivery wheels, skeleton wheels, segmented wheels, transfer drums, support drums, spider wheels, support wheels, guide wheels, guide rollers, and the like.

The ink marking problems inherent in transferring freshly printed substrates have been longstanding. In order to minimize the contact area between the transfer means and the freshly printed substrate, conventional support wheels have been modified in the form of relatively thin disks having a toothed or serrated circumference, referred to as skeleton wheels. However, those thin disc transfer means have not overcome the problems of smearing and marking the freshly printed substrate due to moving contact between the freshly printed substrate and the projections or serrations. Moreover, the attempts to cover the transfer cylinder with a cover material and/or minimize the surface support area in contact with the freshly printed substrate material often resulted in further problems.

Various efforts have been made to overcome the limitations of thin disk skeleton wheels. One of the most important improvements has been completely contrary to the concept of minimizing the surface area of contact. That improvement is disclosed and claimed in U.S. Pat. No. 3,791,644 to Howard W. DeMoore, incorporated by reference herein in its entirety, wherein the support surface of a transfer cylinder in the form of a wide wheel or cylinder is coated with an improved ink repellent surface formed by a layer of polytetrafluoroethylene (PTFE).

During the use of the PTFE coated transfer cylinders in high-speed commercial printing presses, the surface of the coated cylinders must be washed frequently with a solvent to remove any ink accumulation. Moreover, it has also been determined that the PTFE coated cylinders do not provide a cushioning effect and relative movement, which are beneficial.

The limitations on the use of the PTFE coated transfer cylinders have been overcome with an improved transfer cylinder having an ink repellent, cushioning, and supportive fabric covering or the like for transferring the freshly printed sheet. It is now well recognized and accepted in the printing industry world-wide that marking and smearing of freshly printed sheets caused by engagement of the wet printed surface with the supporting surface of a conventional press transfer cylinder is substantially reduced by using the anti-marking fabric covering system as disclosed and claimed in my U.S. Pat. No. 4,402,267 entitled "Method and Apparatus for Handling Printed Sheet Material," the disclosure of which is incorporated herein by reference.

That system, which is marketed under license by Printing Research, Inc. of Dallas, Tex., U.S.A. under the registered trademark SUPER BLUE® includes the use of a low friction coating or coated material on the supporting surface of the transfer cylinder, and over which is loosely attached a movable fabric covering. The fabric covering provided a yieldable, cushioning support for the freshly printed side of the substrate such that relative movement between the freshly printed substrate and the transfer cylinder surface would take place between the fabric covering and the support surface of the transfer cylinder so that marking and smearing of the freshly printed surface was substantially reduced. Various improvements have been made to the SUPER BLUE® system, which are described in more detail in U.S. Pat. Nos. 5,907,998 and 6,244,178 each entitled "Anti-Static, Anti-Smearing Pre-Stretched and Pressed Flat, Precision-Cut Striped Flexible Coverings for Transfer Cylinders"; U.S. Pat. Nos. 5,511,480, 5,603,264, 6,073,556, 6,119,597, and 6,192,800 each entitled "Method and Apparatus for Handling Printed Sheet Material"; U.S. Pat. No. 5,979,322 entitled "Environmentally Safe, Ink Repellent, Anti-Marking Flexible Jacket Covering Having Alignment Stripes, Centering Marks and Pre-Fabricated Reinforcement Strips for Attachment onto Transfer Cylinders in a Printing Press"; and U.S. Pat. No. RE39,305 entitled "Anti-static, Anti-smearing Pre-stretched and Pressed Flat, Precision-cut Striped Flexible Coverings for Transfer Cylinders," each of which is hereby incorporated by reference herein in its entirety. The above cited patents are all owned by Printing Research, Inc. of Dallas, Tex., U.S.A.

SUMMARY

In an embodiment, a removable flexible jacket for use in a printing press having a transfer cylinder for transferring a freshly printed substrate is disclosed. The removable flexible jacket comprises a film sheet, a plurality of beads coupled to the film sheet by a bonding material, wherein the beads are of different sizes, and a coating partially covering the beads, wherein a cusp of at least some of the larger beads is substantially free of the coating.

In an embodiment, another removable flexible jacket for use in a printing press having a transfer cylinder for transferring a freshly printed substrate is disclosed. The removable flexible jacket comprises a sheet of woven fabric, a barrier layer coupled to the sheet of woven fabric, wherein the barrier layer is resistant to volatile organic compounds (VOC), and a beaded film sheet adhered to the barrier layer.

In an embodiment, another removable flexible jacket for use in a printing press having a transfer cylinder for transferring a freshly printed substrate is disclosed. The removable flexible jacket comprises a beaded surface layer, a woven fabric sheet, and a graphic encapsulated between the beaded surface layer and the woven fabric sheet.

In an embodiment, a method of printing substrates is disclosed. The method comprises printing a substrate, wherein the printed substrate is transferred by a transfer cylinder covered by a removable flexible jacket comprising a beaded surface layer over a graphic having a plurality of numbered areas visible through the beaded surface layer and wherein the flexible jacket encapsulates the graphic between at least two barrier layers. The method further comprises inspecting the printed substrate by visually matching a position of a mark on the printed substrate to a numbered visually delimited area of a lattice and cleaning the beaded surface layer over the numbered area of the graphic that associates with the numbered area of the lattice.

In an embodiment, a removable flexible jacket for use in a printing press having a transfer cylinder for transferring a freshly printed substrate comprises a sheet of woven fabric, a beaded film sheet coupled to the sheet of woven fabric, and an image disposed between the sheet of woven fabric and the beaded film sheet. The image is visible through the beaded film sheet, and wherein the image divides at least a portion of a surface of the beaded film sheet into a plurality of zones.

In an embodiment, removable flexible jacket for use in a printing press having a transfer cylinder for transferring a freshly printed substrate comprises a beaded surface layer, a woven fabric sheet, and an image disposed on an outer surface of the beaded surface layer, The woven fabric sheet is coupled to the beaded surface layer.

In an embodiment, a method of printing substrates comprises printing a substrate, aligning a lattice with the printed substrate, matching a position of a mark on the printed substrate to a first zone of the second plurality of zones of the lattice, and cleaning the beaded surface layer over the second zone of the removable flexible jacket. The printed substrate is transferred by a transfer cylinder covered by a removable flexible jacket comprising a beaded surface layer and an image having a first plurality of zones. The lattice comprises a second plurality of zones corresponding to the first plurality of zones of the image of the removable flexible jacket, and the first zone corresponds to a second zone of the first plurality of zones of the image of the removable flexible jacket.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
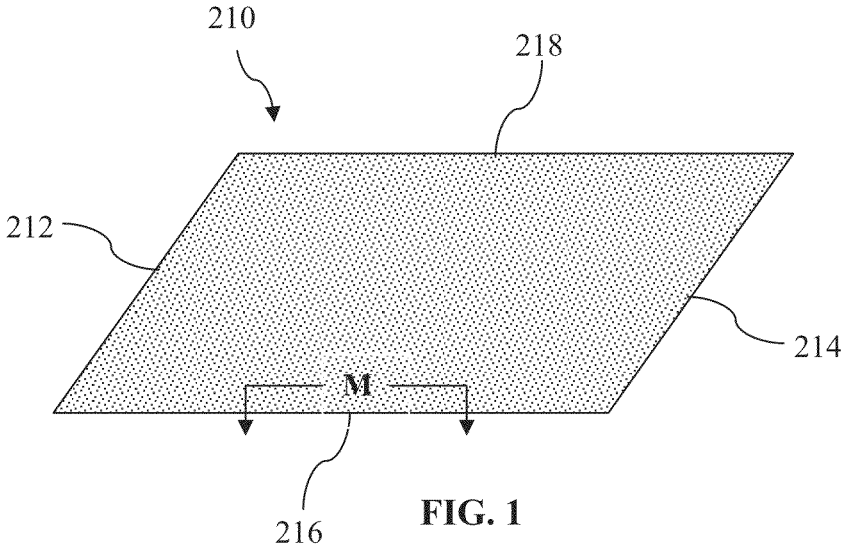
FIG. 1 is an illustration of a flexible jacket according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents. As used herein, "inner" or "inward" when used with a description of a covering or cylinder refers to a direction towards the center of the cylinder. As used herein, "outer" or "outward" when used with a description of a covering or cylinder refers to a direction away from the center of the cylinder and towards a substrate contacting the cylinder or a flexible jacket on the cylinder.

In an embodiment, a transfer cylinder or other cylinder of a printing press may be at least partially enclosed by a flexible jacket that is installed over the cylinder, the flexible jacket comprising an anti-marking surface having a plurality of projections, for example, a plurality of beads coupled to the anti-marking surface. The flexible jacket may be referred to in some contexts as a removable flexible jacket or as a removable anti-marking jacket. An embodiment of a flexible jacket is disclosed herein that promotes one piece installation of the flexible jacket, that promotes high visibility of ink build-up on the flexible jacket, and that promotes ease of cleaning of the flexible jacket, without damaging the jacket. In an embodiment, the flexible jacket incorporates a graphic indicating numbered areas that, when used in combination with a corresponding inspection graphic, may promote locating an ink build-up on the flexible jacket to a specific location and reducing cleaning time by allowing the press operator to forgo cleaning the entire surface of the flexible jacket and instead focus on cleaning only the specific location, thereby reducing downtime of the press. The graphic indicating numbered areas may be referred to as a lattice, a group of abutting rectangles, a group of abutting panes, a group of abutting parallelograms, a group of abutting polygons, or a reticulated figure, where a numeral is located in the different areas. For example, a different numeral may be indicated in each rectangle or in each parallelogram or in each polygon.

The projections project above an average surface height of the anti-marking surface of the flexible jacket or project above the low points of the anti-marking surface of the flexible jacket and touch the printed substrates in a reduced number of points thereby reducing marking of the substrates through smearing the wet ink. The projections may comprise any of a variety of small beads, bodies or particles of a variety of geometries that are coupled to the anti-marking surface. For example, the projections may comprise spherical beads, egg-shaped beads, oblong beads, hemispherical beads, toroidal shaped beads, rounded pyramid shaped beads, polygonal shaped beads, and other shaped beads or particles. In an embodiment, the projections are comprised at least in part of plastic material, glass material, silicon material, and/or ceramic material. Alternatively, the projections may be formed by a process that does not entail coupling beads, bodies, or particles to the anti-marking surface. For example, the projections may be formed by removing material from the anti-marking surface to leave projections separated by gouged out or cut out areas such as holes and/or grooves. Alternatively, the projections may be formed by stippling the anti-marking surface.

In an embodiment, a coating is applied over the projections using an applicator roller. The coating is applied in such a way that at least some of the cusps of the projections are substantially free from the coating. For example, as the applicator roller applies the coating to the anti-marking surface, pinch points occur between the applicator roller and the high points of at least some of the projections, thereby reducing the initial amount of coating in contact with those high points. Further, the coating tends to flow down off the high points of the projections and into troughs or valleys that are formed between the projections.

The amount of coating material that is distributed across the anti-marking surface during manufacturing may be limited so that the coating does not cover the cusps of all of the projections. By controlling the amount of coating material distributed across the anti-marking surface, the anti-marking properties of the projections may be retained. It is thought that excess coating material tends to make the anti-marking surface smoother and more prone to marking. During printing operation, ink from printed substrates that contact the anti-marking surface attached to the transfer cylinder of the printing press may collect in the low points or valleys between the projections, hence avoiding marking the printed substrates with the ink. If the anti-marking surface were smoother, these valleys or low places would be reduced in size or eliminated entirely, and then ink deposited onto the anti-marking surface would be more likely to transfer back to printed substrates, marring these printed substrates. The coating may further reduce the interaction of solvents applied to clean the anti-marking surface with an adhesive, a resin that bonds on curing, or other bonding material coupling the projections, for example glass beads, to a film sheet of the flexible jacket.

In an embodiment, the coating applied over the projections is an ultraviolet curable coating. The ultraviolet curable coating is cured after application by exposure to ultraviolet light. This ultraviolet coating resists bonding to ultraviolet curable inks that may be used in the printing press to print substrates. As a consequence, the ultraviolet coating is easily cleaned and even allows relatively easy cleaning when the ultraviolet ink has dried on the anti-marking surface. In this case, the dried ultraviolet ink readily peels off or sloughs off during cleaning. It is thought that cleaning the anti-marking surface that has been coated with an ultraviolet coating as described above reduces damage to and/or removal of the projections coupled to the film sheet, because press operators are able to adequately clean the anti-marking surface using less physical pressure and less aggressive scrubbing action. The removal of the projections and/or beads in known anti-marking surfaces may further increase the difficulty of cleaning those anti-marking surfaces, as the place of removal becomes a relatively deep cavity that collects and holds ink, resisting cleaning.

In an embodiment, the flexible jacket is further comprised of a backing sheet that is coupled to a barrier layer. The barrier layer is further coupled to a film sheet, where the projections of the anti-marking surface are coupled to the film sheet. The backing sheet is in contact with the transfer cylinder. As cleaning solvents and other solvents in the press contact the backing, for example at the outer edges of the backing, the solvents may be wicked up or drawn further into the backing, away from the edges. The barrier layer reduces or blocks propagation of the solvent away from the backing, up into the film sheet. If the solvent were able to propagate above the barrier layer, the solvent may degrade adhesive material, resin material, or other bonding material that couples the barrier layer to the film sheet. If the solvent were able to propagate above the barrier layer, the solvent may degrade adhesive material, resin material, or other bonding material that couples the projections, for example glass beads, to the film sheet. In an embodiment, the resin material bonds on curing.

In an embodiment, a graphic may be encapsulated within the flexible jacket. For example, the graphic may be encapsulated between the barrier layer coupled to the backing and the film sheet coupled to the projections. By encapsulating the graphic, the graphic is protected from damage from solvents. Further, by encapsulating the graphic, the migration of graphical material, such as dried ink or decal material, out into the printing press where it may foul the press or where it may damage printed substrates is prevented. The graphic may not extend from edge to edge of the flexible jacket.

It is contemplated that a variety of graphical elements maybe encapsulated. For example, text providing instructions for installation or cleaning the flexible jacket may be printed and encapsulated as a graphic. For example, an image and/or textual information identifying a source for reordering the flexible jacket may be printed and encapsulated as a graphic. For example, registration markings may be printed and encapsulated. The registration markings may be used to promote easy visual determination of movement of the transfer cylinder. The registration markings may be used to promote visual determination of a build-up of ink on the anti-marking surface. The registration markings may be used to promote visual determination of an amount of wear of the anti-marking surface. In an embodiment, the backing is a light colored material such as white or off-white and the film sheet and anti-marking surface are translucent. This may promote visual determination of a build-up of ink on the anti-marking surface. In another embodiment, however, the backing may be a dark color or intermediate color. The graphic or graphics may be printed on the barrier layer or on either the upper face or lower face of the film sheet. The graphic or graphics may be applied as a decal to the barrier layer or on either the upper face or lower face of the film sheet. The graphic or graphics may be printed on a substrate, for example a piece of paper, and the substrate may be encapsulated within the flexible jacket.

The graphic or graphics can also be used with any of the cylinder coverings present in a printing press. The graphic may include layer having an image disposed thereon, or in some embodiments, the image may be directly disposed on another layer without having a dedicated graphic layer. The image can have a coating, film layer, and/or barrier layer disposed between the image and a printed substrate (e.g., in an outward direction from the image) to prevent solvents, inks, or other chemicals from damaging the image. The outer layer can be fluid resistant and may act as a barrier to protect the image from fluids used in the printing process. In some embodiments, a layer may also be disposed inward from the image, though this layer may not be needed in some cases.

As noted above, the image associate with a graphic can be used with existing cylinder covers to allow a desired cleaning location to be quickly identified, thereby saving time in identifying and cleaning the cylinder. The image can be used with an impression cylinder, a press blanket, a transfer cylinder, or any other rollers or cylinders that accept coverings. An experienced pressman may be capable of identifying the approximate location of the cylinder causing a marking and then use the graphic along with a key to identify the portion of the covering on the cylinder causing the marking problem. The specific portion of the covering can then be cleaned without cleaning the entire cylinder covering. This may limit the time needed to clean the cylinder covering, and thus, the downtime of the printing press. The ability to clean only a portion of the cylinder covering may also limit the amount of solvent used in the cleaning process. The solvents can contact the printed sheets once the press is restarted and result in a number of prints being ruined. By limiting the amount of solvent used, the number of prints that must be discarded can be reduced. In some embodiments, a solvent free cleaning can be performed to further reduce the number of prints that are discarded.

Turning now to FIG. 1, a flexible jacket 210 is described. The flexible jacket 210 has a gripper edge 212, a tail edge 214, a gear edge 216, and an operator edge 218. The flexible jacket 210 is generally a thin rectangular sheet. In an embodiment, the flexible jacket 210 may have attaching mechanisms for coupling the flexible jacket 210 to a transfer cylinder of a printing press. In some contexts, the flexible jacket 210 may be referred to as a removable flexible jacket, as it may be installed onto the transfer cylinder and removed from the transfer cylinder. Transfer cylinders and printing press structures and operation are assumed to be well known, but some brief description of these conventional structures is provided herein below with reference to FIG. 4A, FIG. 4B, FIG. 5, FIG. 6A, and FIG. 6B. The surface of the flexible jacket 210 visible in FIG. 1 is an outer surface of the flexible jacket 210 and may be referred to in some contexts as an anti-marking surface. In use, the outer surface of the flexible jacket 210 may partially contact printed substrates as they are passed over the transfer cylinder through the printing press.

Figure 2A:
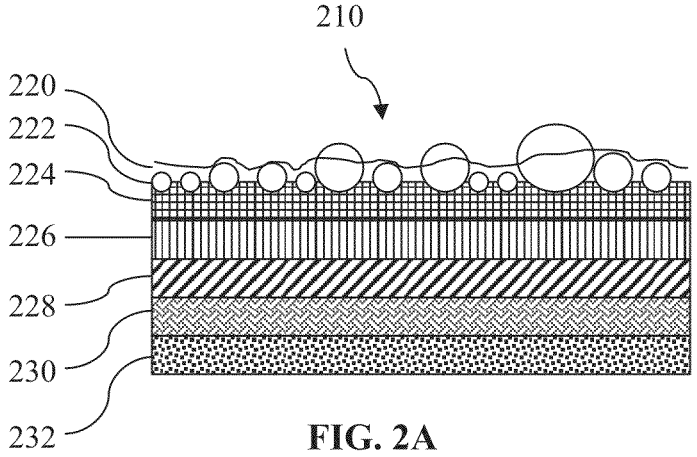
FIG. 2A is an illustration of a flexible jacket according to an embodiment of the disclosure.

Turning now to FIG. 2A, a section view of the flexible jacket 210 along cut line M is described. In an embodiment, the flexible jacket 210 is comprised of a plurality of sheets and/or layers. A coating layer 220 partially covers beads in a bead layer 222. The beads of the bead layer 222 are coupled to a film sheet 226 by a first bonding layer 224. The flexible jacket 210 may further comprise a backing sheet 232 coupled to a barrier layer 230. The film sheet 226 may be coupled by a second bonding layer 228 to the barrier layer 230. While the disclosure hereinafter refers to beads and the bead layer 222, in an embodiment another layer that features projections may be used in the place of the bead layer 222.

In general, the thicknesses of the components 224, 226, 228, 230, 232 as illustrated in FIG. 2A are not meant to be drawn to scale or to represent the thickness of one component relative to the thickness of another component. The different sizes of beads as illustrated in the bead layer 222 is meant to illustrate a range of sizes of the beads but not to specifically represent relative sizes among the beads or to enumerate a discrete number of different sizes. The thickness of the coating layer 220 is not meant to illustrate a relative thickness of the coating layer 220 to other layers but rather to show that the coating layer 220 does not completely cover all the beads, for example does not cover the peaks or cusps of the largest beads.

The bead layer 222 may comprise a plurality of beads that are bonded by the first bonding layer 224 to the film sheet 226. In an embodiment, the film sheet 226 may comprise Mylar or some other material. The beads may comprise spherical, ovoid, or other shapes. The beads may comprise glass beads, ceramic beads, plastic beads (e.g., silicone beads, polymer beads, etc.), metal beads, and beads composed of other materials. In an embodiment, the beads are different sizes as shown. The bonding layer 224 may comprise adhesive material, resin material, or other bonding material that bonds the beads of the bead layer 222 to the film sheet 226. In an embodiment, the resin material bonds on curing. The bead layer 222 may be coated with a liquid coating material that is applied with an applicator roller that rolls across the bead layer 222. In this process, the applicator roller is held in intimate contact with at least some of the beads, for example the larger beads, of the bead layer 222. As a result of this intimate contact, pinch points are created between some of the beads of the bead layer 222 and the applicator roller. At the pinch points the liquid coating material is substantially excluded, with the possible exception of a trivial and negligible residue, from at least the larger beads of the bead layer 222. As a result, the liquid coating material is substantially excluded from the tops of or the cusps of the larger beads of the bead layer 222. In an alternative embodiment, the liquid coating material may be applied with another mechanism, for example a device having a doctor blade to wipe across the bead layer 222 in direct contact with at least some of the beads, thereby creating pinch points between the higher beads and the doctor blade. The coating layer 220 may be said to be thicker in regions between beads than over the beads, for example over medium sized beads, in the bead layer 222.

Figure 2B:
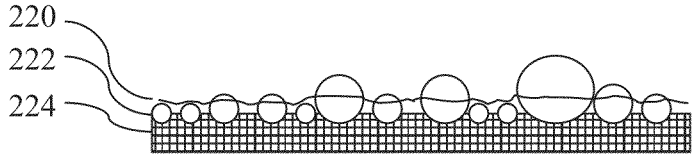
FIG. 2B is an illustration of an alternative amount of coating over a plurality of beads according to an embodiment of the disclosure.

Without wishing to be bound by theory, it is thought that capillary action (e.g., surface tension forces) and/or the force of gravity also contributes to excluding the liquid coating material substantially from the tops of or the cusps of others of the beads as the liquid coating material flows down off the peaks or the cusps of the beads and flows into the regions between the beads which may be referred to as troughs or valleys between the beads. The amount of liquid coating material that is applied to the bead layer 222 may be controlled during manufacturing to limit the total amount of liquid coating material that is deposited. By controlling the amount of liquid coating material that is applied to the bead layer 222, the extent to which the larger beads of the bead layer 222 are substantially uncoated may be controlled. FIG. 2A illustrates a depth of the coating layer 220 corresponding to applying relatively more liquid coating material per unit area of the bead layer 222, and FIG. 2B illustrates a depth of the coating layer 220 corresponding to applying relatively less liquid coating material per unit area of the bead layer 222. In FIG. 2B it can be seen that some beads of the bead layer 222 are substantially uncoated that are thinly coated in FIG. 2A. The thickness of the coating layer 220 as illustrated in FIG. 2B is not meant to represent a relative thickness of the coating layer 220 to other layers; the thickness of the coating layer 220 as illustrated in FIG. 2B is meant to generally illustrate that a thinner coating layer 220 would tend to leave more of the beads in the bead layer 222 uncoated.

In an embodiment, it is desirable to keep some of the larger beads of the bead layer 222 substantially uncoated in order to preserve some variation in the texture of the surface created by the bead layer 222. It is thought that the variation in the texture—for example the high points projecting above lower points—contribute to the reduction of marking of substrates as they pass over the transfer cylinder and over the flexible jacket 210. Dispensing too much liquid coating material may reduce the surface texture roughness and/or surface texture variation to such an extent that the flexible jacket 210 would begin to mark the substrates.

In an embodiment, the liquid coating material is an ultraviolet curable coating material. After applying the UV coating material on the bead layer 222 with the applicator roller to form the coating layer 220, the coating layer 220 may be cured by exposure to an ultraviolet light source. The liquid coating material may be a low viscosity liquid, and the low viscosity of the coating material may contribute to the coating material flowing off the cusps of the beads of the bead layer 222.

The use of a UV coating material to form the coating layer 220 may promote ease of removal of ink from the flexible jacket 210. In the past, ink may have been difficult to remove from the components that cover the transfer cylinder. For example a press operator may have used considerable pressure and aggressive scrubbing action to rub the accumulated ink off the surface of the component covering the transfer cylinder. If the component featured beads bonded to a film, the aggressive cleaning may have dislodged some of the beads from the film. Cavities created at the locations of dislocated beads tended to be places where ink would accumulate in later printing and may have contributed to increased marking of substrates. Additionally, later cleaning would be made more difficult as a result of the ink pooling in the cavities left where the beads were rubbed off. The coating layer 220 taught herein eases the task of cleaning the flexible jacket 210 in several ways. By partially filling in the valleys and/or troughs between the beads of the bead layer 222, the ink is prevented from propagating into the low points between the beads. Additionally, in an embodiment that forms the coating layer 220 using a UV coating material, the removal of even dried UV ink is made easier. Because the UV coating material is cured before the flexible jacket 210 is used in a printing operation, the UV ink that may be deposited on the flexible jacket 210 and the coating layer 220 does not tend to bind to the UV coating of the coating layer 220. It is thought that the coating layer 220 may increase the strength of the bonding of the beads in the bead layer 222 to the flexible jacket 210. In some contexts, the combination of the bead layer 222, the coating layer 220, the first bonding layer 224, and the film sheet 226 may be referred to as a beaded film sheet or a beaded surface layer. In some press environments the beaded film sheet may be used as a transfer cylinder cover, without the backing sheet 232 and without the barrier layer 230.

The backing sheet 232 may comprise woven fabric. The backing sheet 232 may be woven of natural fibers and/or synthetic fibers. The backing sheet 232 may be partially woven from cotton fibers, linen fibers, woolen fibers, polyester fibers, polypropylene fibers, nylon fibers, and/or other types of fibers. In an embodiment, the backing sheet 232 is densely and/or tightly woven. The backing sheet 232 may be formed of a woven material generally referred to as a canvas-type material. The backing sheet 232 may have some surface texture, resulting from weaving from threads or fibers, but the average thickness of the backing sheet 232 is substantially uniform and/or consistent across the whole of the backing sheet 232. For example, in an embodiment, the average thickness of the backing sheet 232 determined over a square inch of the backing sheet 232 conforms substantially to the average thickness of the backing sheet 232 determined over any other larger area of the backing sheet 232, for example agrees within +/−10% of the average thickness. In an embodiment, the backing sheet 232 may be white or near-white in color. This color may promote more readily distinguishing the amount of ink build up on the flexible jacket 210 and/or seeing graphics encapsulated within the flexible jacket 210, as will be discussed further hereinafter. Alternatively, in another embodiment, the backing sheet 232 may be a dark color or an intermediate color.

The barrier layer 230 may be comprised of vinyl, polyvinyl chloride (PVC), and/or other plastics materials. In an embodiment, the barrier layer 230 is embossed onto the backing sheet 232, for example coupled to the backing sheet 232 in a process that applies heat and pressure on the backing sheet 232 and the barrier layer 230. In another embodiment, however, the barrier layer 230 may be coupled to the backing sheet 232 in another way. The barrier layer 230 may be coated onto the backing sheet 232, for example sprayed onto or applied with an applicator roller onto the backing sheet 232. The barrier layer 230 may be referred to in some contexts as a barrier coating, a barrier film, or a barrier sheet. In some embodiments, the backing sheet 232 and/or the film sheet 226 may be considered a barrier layer, and a separate barrier layer may not be needed.

In an embodiment, the barrier layer 230 is translucent and/or a white or near-white in color. When the flexible jacket 210 is coupled to the transfer cylinder of a printing press, solvents may contact the backing sheet 232 at the outer edges of the flexible jacket 210—for example at one or more of the gripper edge 212, the tail edge 214, the gear edge 216, and/or the operator edge 218. The solvent may wick into the interior of the backing sheet 232 due to capillary action of woven fibers. In an embodiment, the barrier layer 230 blocks or attenuates the propagation of the solvents from the backing sheet 232 upwards into the second bonding layer 228, the film sheet 226, and/or the first bonding layer 224, thereby preventing or reducing degradation of the second bonding layer 228, the film sheet 226, and/or the first bonding layer 224 caused by the solvents. In an embodiment, the barrier layer 230 may be comprised of material that is resistant to solvents, for example resistant to volatile organic compounds (VOC). In an embodiment, the barrier layer 230 is resistant to high VOC solvents.

The second bonding layer 228 bonds and/or couples the barrier layer 230 to the film sheet 226. The second bonding layer 228 may comprise adhesive material, resin material, or other bonding material. In an embodiment, the resin material bonds on curing. In an embodiment, the film sheet 226 may be considered to be a barrier that blocks or attenuates propagation of solvents upwards into the first bonding layer 224. In an embodiment, the coating layer 220 may be considered to be a barrier that blocks or attenuates propagation of solvents downwards into the first bonding layer 224. In an embodiment, it is contemplated that a flexible jacket may be formed of the coating layer 220, the bead layer 222, the first bonding layer 224, and the film sheet 226 alone, without the backing sheet 232, the barrier layer 230, or the second bonding layer 228. This was referred to above as a beaded film sheet or a beaded surface layer. Such a beaded film sheet may be used as a flexible jacket cover for a transfer cylinder in some press operating environments.

Figure 3A:
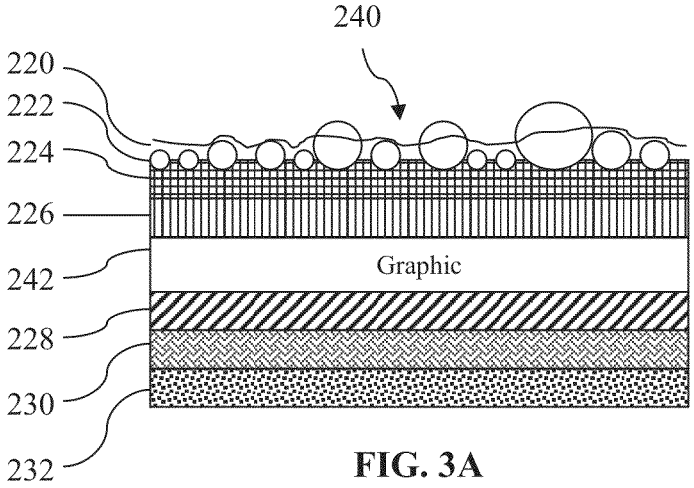
FIG. 3A is an illustration of a flexible jacket encapsulating a graphic according to an embodiment of the disclosure.
Figure 3B:
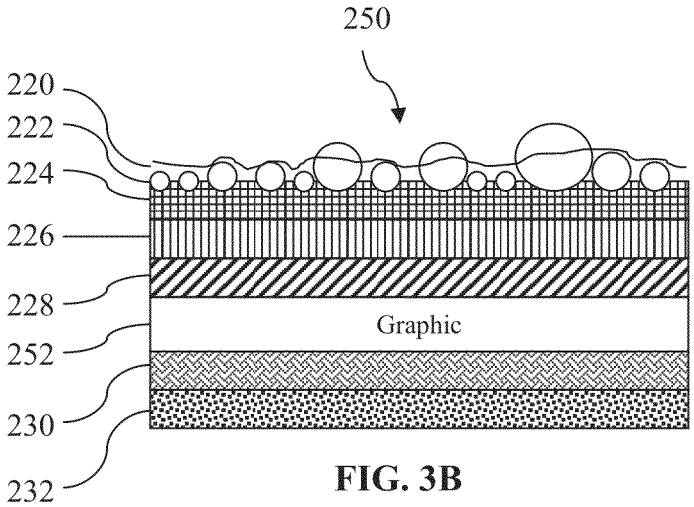
FIG. 3B is an illustration of another flexible jacket encapsulating a graphic according to an embodiment of the disclosure.
Figure 3C:
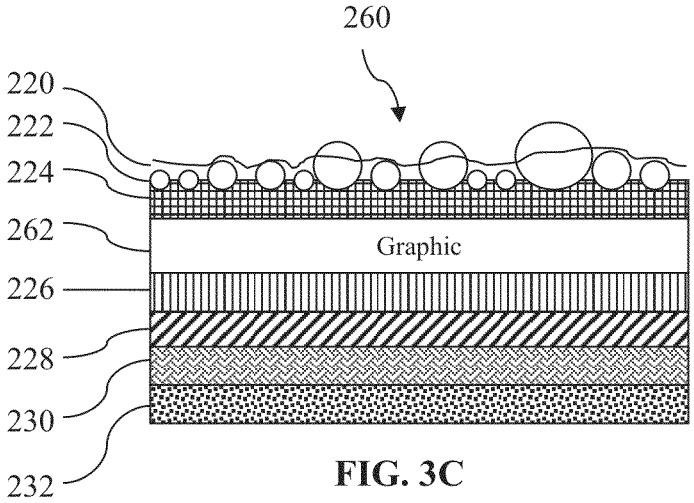
FIG. 3C is an illustration of another flexible jacket encapsulating a graphic according to an embodiment of the disclosure.

Turning now to FIGS. 3A-3H, alternative embodiments of flexible jackets are described. FIG. 3A shows a flexible jacket 240 having a graphic 242 encapsulated between the film sheet 226 and the second bonding layer 228. FIG. 3B shows a flexible jacket 250 having a graphic 252 encapsulated between the barrier layer 230 and the second bonding layer 228. FIG. 3C shows a flexible jacket 260 having a graphic 262 encapsulated between the film sheet 226 and the first bonding layer 224. The coating layer 220, the bead layer 222, the first bonding layer 224, the film sheet 226, the second bonding layer 228, the barrier layer 230, and the backing sheet 232 illustrated in FIG. 3A, FIG. 3B, and FIG. 3C are each the same or similar to the corresponding components described with reference to FIG. 2A above. The flexible jacket 240, 250, 260 may be referred to as a removable flexible jacket in some contexts. In some contexts, the graphic 242, 252, 262 may be referred to as an encapsulated graphic. In general, the thicknesses of the components 224, 226, 228, 230, 232, 242, 252, 262 as illustrated in FIG. 3A, FIG. 3B, and FIG. 3C are not meant to be drawn to scale or to represent the thickness of one component relative to the thickness of another component. Additionally, it is understood that in an embodiment the graphic 242, 252, 262 may not extend from gripper edge 212 to tail edge 214 and from gear edge 216 to operator edge 218. While described below as singular, the flexible jacket 240, 250, 260 may encapsulate a plurality of graphics 242, 252, 262.

As used herein, encapsulated means that the graphic 242, 252, 262 is sandwiched between a lower barrier and an upper barrier that block or attenuate propagation of solvents to the graphic 242, 252, 262. The graphic 242, 252, 262 may be encapsulated like a filling may be encapsulated in a ravioli or a filling may be encapsulated in a pastry. Additionally, encapsulation further means that the graphic 242, 252, 262 is retained in position within the flexible jacket 240, 250, 260 such that under conditions of normal use (e.g., the flexible jacket 240, 250, 260 is not worn out and/or damaged so as to be unsuitable for continued use) material from the graphic 242, 252, 262, for example dried ink, decal material, and/or printed substrate, is retained and prevented from migrating out of the flexible jacket 240, 250, 260 to foul the printing press and/or to mar printed substrates.

It is contemplated that the graphic 242, 252, 262 may comprise a variety of graphical content. For example, the graphic 242, 252, 262 may comprise a graphical image, figure, or device for registering, assessing, and/or distinguishing an amount of ink buildup on the flexible jacket 240, 250, 260. For example, the graphic 242, 252, 262 may comprise an image having triangular forms and intersecting lines that may be used to determine an average level of ink build up by observing how deeply the triangular forms can be visually observed to be cut. For example, the graphic 242, 252, 262 may comprise an image having a plurality of areas of different density of cross-hatching that may be used to determine an average level of ink build up, such that a very finely cross-hatched area may appear to be solid due to the contribution of ink build up while coarsely cross-hatched area may continue to be visibly distinguished as cross-hatched. By providing a range of cross-hatching densities, it may be possible to determine different levels of ink build up and employ this relative measurement to determine when to clean the flexible jacket 240, 250, 260.

The graphic 242, 252, 262 may comprise an image, figure, or device for more readily perceiving a motion of the transfer cylinder to which the flexible jacket 240, 250, 260 is attached. For example, the graphic 242, 252, 262 may comprise a plurality of parallel lines perpendicular to the direction of rotation of the transfer cylinder running from the gear edge 216 to the operator edge 218 to promote ease and/or promptitude of distinguishing motion of the transfer cylinder. In an embodiment, these parallel lines may look similar to stripes. The graphic 242, 252, 262 may comprise a plurality of diagonal lines running from the gear edge 216 to the operator edge 218 to promote ease and/or promptitude of distinguishing motion of the transfer cylinder. The graphic 242, 252, 262 may comprise a graphic image, figure, or device for more readily assessing a wear condition of the flexible jacket 240, 250, 260.

In an embodiment, the graphic 242, 252, 262 may comprise a plurality of parallel lines intersected by a plurality of perpendicular lines, which form boxes, rectangles, areas, or zones. In an embodiment, a problem area observed on one or more printed substrates may be associated to one or more specific areas on flexible jacket 240, 250, 260 so that the subject area or areas may be cleaned. A variety of graphics indicating numbered areas are described further below with reference to FIG. 7A, FIG. 7B, FIG. 8A, FIG. 8B, FIG. 9A, FIG. 9B, and FIG. 10.

The graphic 242, 252, 262 may incorporate text that provides instructions for installing and/or cleaning the flexible jackets 240, 250, 260. The graphic 242, 252, 262 may comprise text providing the postal address, the web address, and/or the phone number for reordering replacement flexible jackets 240, 250, 260. The graphic 242, 252, 262 may incorporate text and/or figures that associate to a manufacturer and/or seller of the flexible jacket 240, 250, 260, for example a trademark device. The graphic device, figure, image, and/or text may be provided by printing and/or by applying a decal onto the barrier layer 230 or onto the film sheet 226. In an embodiment, the graphic 242, 252, 262 may be printed on a substrate, for example a piece of paper, and encapsulated in the flexible jacket 240, 250, 260. In an embodiment, the bead layer 222, the coating layer 220, the first bonding layer 224, the film sheet 226, the second bonding layer 228 may be transparent and/or translucent and the backing sheet 232 and/or the barrier layer 230 may be white or near-white in color, thereby promoting seeing the graphic device, figure, image, and/or text when the flexible jacket 240, 250, 260 is installed over the transfer cylinder, for example when looking down onto the flexible jacket 240, 250, 260 from the viewpoint of FIG. 1.

In an embodiment, a flexible jacket may be double sided and may be formed of a first assembly of the coating layer 220, the bead layer 222, the first bonding layer 224, and the film sheet 226 alone, without the backing sheet 232, without the barrier layers 230, and without the second bonding layer 228 coupled to a second assembly of the coating layer 220, the bead layer 222, the first bonding layer 224, and the film sheet 226 alone, without the backing sheet 232, without the barrier layers 230, and without the second bonding layer 228. For example, a flexible jacket may be formed by coupling two beaded film sheets to each other, with bead layer 222 facing outwards. The first assembly and the second assembly may be coupled together with their bead layers 222 facing away from each other and their film sheet 226 proximate to each other. In an embodiment, a graphic may be encapsulated between the two assemblies. The graphic may be visible from the outside of either of the two bead layers 222 of this double sided flexible jacket. The graphic may be symmetrical so it looks substantially the same when viewed from either of the two bead layers 224. Alternatively, the graphic may be printed on two sides of a single opaque substrate.

Figure 3D:
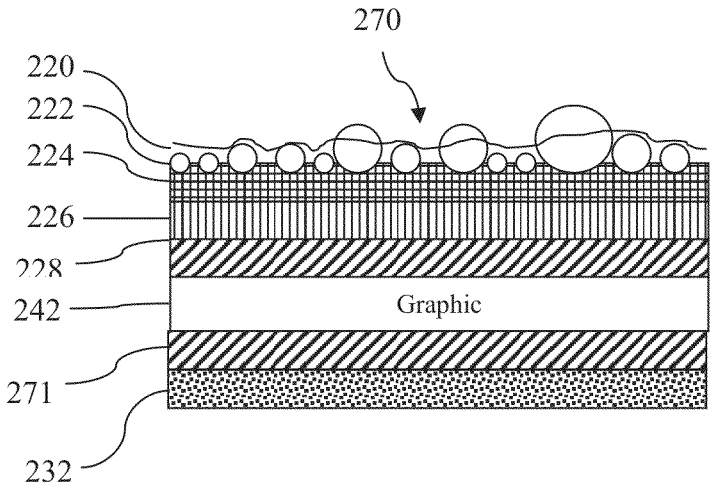
FIG. 3D is an illustration of a flexible jacket according to an embodiment of the disclosure.

Another embodiment of a flexible jacket 270 is shown in the cross-sectional view in FIG. 3D. In this embodiment, the graphic 242 may be printed on a layer and disposed between the film sheet 226 and the backing sheet 232. In this embodiment, the flexible jacket 270 may comprise an optional coating layer 220, the bead layer 222, the first bonding layer 224, and the film layer 226 on a side of the flexible jacket 270 in contact with the wet ink and a backing layer 232 on the side of the flexible jacket 270 contacting a transfer cylinder. The graphic 242 may be disposed between the outer and inner portions of the flexible jacket 270. In an embodiment, the graphic 242 may comprise an image printed on a layered material such as paper, fabric, a woven or solid polymeric material, any of which may be coated to allow the ink used to print the image to bond to the graphic layer. For example, the ink used to produce the image on the graphic layer may be water based, solvent based, or any other suitable inks Some inks may tend to bond to certain surfaces without bonding as well to others. The coating may be used to provide a suitable surface for the inks used. In some embodiments, a non-ink marking may be used to form the image. For example, etching, molding, laser inscribing or the like may also be used to form the image on the graphic layer 242. The coating layer 220, the bead layer 222, the first bonding layer 224, the film sheet 226, the barrier layer 230, and the backing sheet 232 illustrated in FIG. 3D can the same or similar to the corresponding components described with reference to FIGS. 2A-3C above.

As shown in FIG. 3D, the graphic 242 may be disposed between the film layer 226 and the backing layer 232. The graphic 242 can be bonded to the film layer 226 and/or the backing layer 232 using one or more bonding layers 228, 271. The bonding layer 228 and/or the bonding layer 271 can be the same or similar to the first or second bonding layers described above with respect to FIGS. 2A-3C. In an embodiment, the graphic 242 can be coupled to the backing sheet 232 and/or the film layer 226 in a process that applies heat and pressure to bond the layers together. In general, the graphic 242 may be disposed in the flexible jacket 270 so that the printing is visible through the film sheet 226 and the bead layer 222.

Figure 3E:
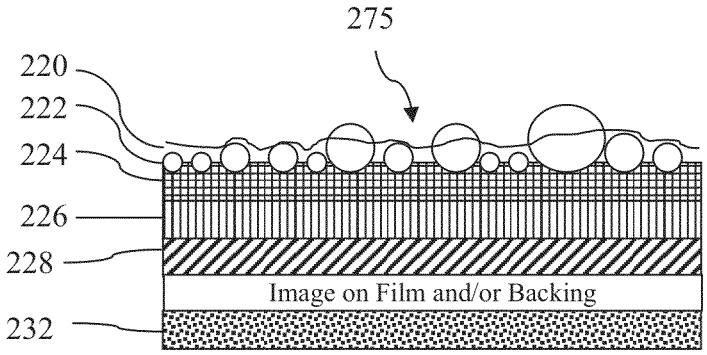
FIG. 3E is an illustration of another flexible jacket according to an embodiment of the disclosure.

Still another embodiment of a flexible jacket 275 is shown in the cross-sectional view in FIG. 3E. In this embodiment, the graphic may be printed directly on the surface of the backing sheet 232 and/or the film 226. In this embodiment, the image of the graphic may not be disposed on a separate material, which may allow the overall flexible jacket 275 to be thinner for proper spacing on the transfer cylinder. In this embodiment, the image may be printed directly on the inner surface of the film layer 226 that is facing the backing sheet 232 and/or on the outer surface of the backing sheet 232 that is facing the film layer 226. In general, the image may be disposed in the flexible jacket 270 so that the printing is visible through the film sheet 226 and the bead layer 222. In this way the image and the ink forming the image can be disposed between the film layer 226 and the backing sheet 232. A bonding layer 228 may be disposed between the film layer 226 and the backing sheet 232 to couple the two layers together. Since the image is disposed on at least one of the surfaces of the film layer 226 and/or the backing sheet 232, only a single bonding layer 228 may be needed. An optional coating may be applied to the surface of the film layer 226 and/or the backing sheet 232 to aid in bonding the ink forming the image to the corresponding surface on which the ink is disposed. In some embodiments, a non-ink marking may be used to form the image. For example, etching, molding, laser inscribing or the like may also be used to form the image on the film layer 226 and the backing sheet 232. The coating layer 220, the bead layer 222, the first bonding layer 224, the film sheet 226, the barrier layer 230, and the backing sheet 232 illustrated in FIG. 3E can the same or similar to the corresponding components described with reference to FIGS. 2A-3D above. In this embodiment, the film layer 226 and/or the backing sheet 232 may optionally act as a barrier. In some embodiments, a barrier may not be required. For example, the ink or other manner of forming the image may not be susceptible to distortion or fouling from cleaners (e.g., solvents, etc.) or the printing ink.

Figure 3F:
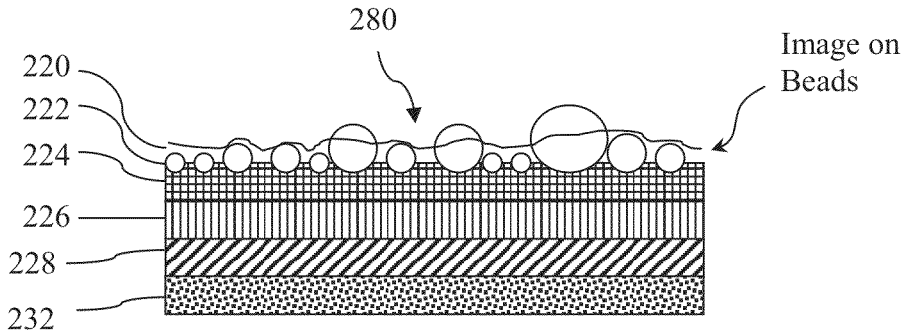
FIG. 3F is an illustration of still another flexible jacket according to an embodiment of the disclosure.

Still another embodiment of a flexible jacket 280 is shown in the cross-sectional view in FIG. 3F. In this embodiment, the graphic image may be printed directly on the surface of the bead layer 222 and the coating layer 220 may act as a barrier to prevent the fouling of the image on the bead layer 222. In this embodiment, the coating layer 220 can be disposed over the image formed on the bead layer 222, and the remaining layers may include the first bonding layer 224 used to couple the beads to the film sheet 226, and a second bonding layer 228 to couple the film sheet 226 to the backing sheet 232. The coating layer 220, the bead layer 222, the first bonding layer 224, the film sheet 226, the second bonding layer 228, and the backing sheet 232 illustrated in FIG. 3F can the same or similar to the corresponding components described with reference to FIGS. 2A-3D above. While shown as a specific layer configuration in FIG. 3F, the flexible jacket 280 may comprise any of the layers described with respect to FIGS. 2A-3E where the image is disposed on the bead layer 222.

In this embodiment, the material used to form the projections (e.g., the beads, etc.) may be selected to allow an ink used to form the image to bond to the bead layer 222. In an embodiment, the bead layer may be formed from glass beads, sand, or the like. In some embodiments, a primer layer or other coating may be used to allow the ink to bond to the bead layer 222. In some embodiments, a non-ink marking may be used to form the image. For example, etching, molding, laser inscribing or the like may also be used to form the image on the film layer 226 and the backing sheet 232. In some embodiments, the selection of the beads may be used to form the image. For example, different bead sizes, shapes, colors, materials, or the like can be used to form the image in the bead layer 222. Once the image is disposed on the bead layer 222, the coating layer 220 may be disposed over the bead layer 222 and the image to prevent damage to the image layer. If the selection of the beads is used to form the image, the optional coating layer 220 may not be needed.

Figure 3G:
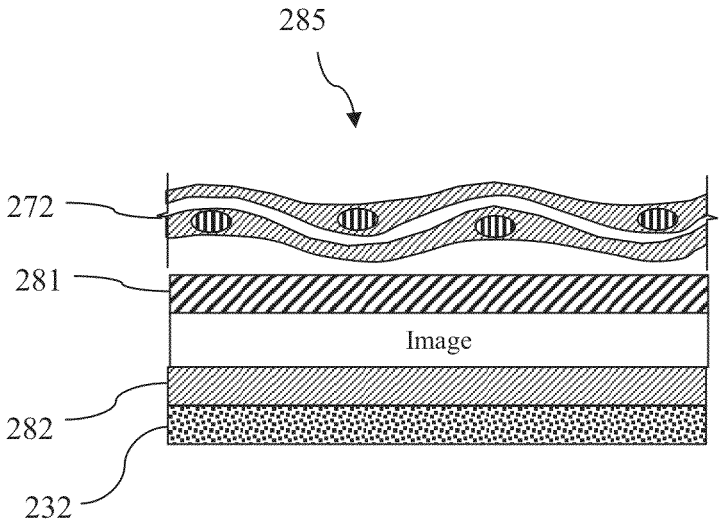
FIG. 3G is an illustration of yet another flexible jacket according to an embodiment of the disclosure.

Yet another embodiment of a flexible jacket 285 is shown in the cross-sectional view in FIG. 3G. In this embodiment, the graphic image may be used with a woven material 272 having free play disposed over a base or backing layer 232.

The base layer may comprise a backing sheet 232 as described herein. An image may be disposed on the backing sheet 232 as noted herein. For example, the image may be directly disposed on the backing sheet 232, a primer 282 may be used to allow the image to be disposed on the backing, the image may be printed on a graphic that can then be coupled to the backing, or any combination thereof. When the image is disposed directly on the backing, with or without a primer layer, a coating 281 may optionally be disposed over the image to seal the image and act as a barrier from solvents or other cleaning solutions. The base layer may comprise one or more connection features such as clips, hook and loop type connectors, or the like on ends of the flexible jacket to allow the woven material to attach to the backing sheet 232. The backing sheet 232 illustrated in FIG. 3G can the same or similar to the corresponding components described with reference to FIGS. 2A-3D above.

In an embodiment, the woven material 272 is a fabric, such as a woven material having warp strands 273 and weft strands 274. A coating may be disposed on one or more of the strands that comprises fluoropolymer, such as PTFE, FEP, and PFA. The coating may be applied to a woven material after weaving has been completed, as by immersing the woven material in a solution, for example, of PTFE resin or material or by applying a coating of PTFE on the woven material. In an embodiment, the coated woven material may be heated to a temperature effective to cure the coating of PTFE. The warp and weft (fill) strands 273, 274 may comprise natural fibers or synthetic fibers. In another embodiment, the strands 273, 274 may not have a coating. In an embodiment, at least some of the warp and weft strands 273, 274 may comprise fluoropolymer, such as PTFE, FEP, and PFA, for example the strands 273, 274 may be woven partly from thread that is coated with PTFE. In another embodiment, the warp and weft strands 273, 274 may consist of threads that are manufactured partly from fluoropolymer, such as PTFE, FEP, and PFA, for example a thread manufactured of a composition comprising PTFE and another suitable material. In another embodiment, the strands 273, 274 may be woven from threads consisting essentially of fluoropolymer, such as PTFE, FEP, and PFA. In some of these embodiments, the strands 273, 274 may be woven both from threads comprising fluoropolymer, such as PTFE, FEP, and PFA, and other threads, such as metallic threads, metal threads, colored threads, bi-component yarns, such as NEGA-STAT, and other threads. Strands 273, 274 woven from threads comprising fluoropolymer may be able to withstand temperatures up to about 400 degrees Fahrenheit. Examples of suitable configurations of the woven material and construction are described in U.S. Pat. Nos. 5,907,998; 5,979,322; 6,119,597; and 6,244,178, referenced previously and owned by Printing Research Inc. of Dallas, Tex., U.S.A. While shown as a specific layer configuration in FIG. 3G, the flexible jacket 285 may comprise any of the layers described with respect to FIGS. 2A-3F where a woven material is attached to the flexible jacket with free play.

The woven material may be coupled to the backing sheet 232 so that the woven material 272 has free play with respect to the backing sheet 232. The openness of the woven material may allow the image to be seen through the woven material when the flexible jacket 285 is disposed on a cylinder. As described in more detail herein, the image may be used to determine a specific location or region on the flexible jacket 285 to be cleaned during use.

Figure 3H:
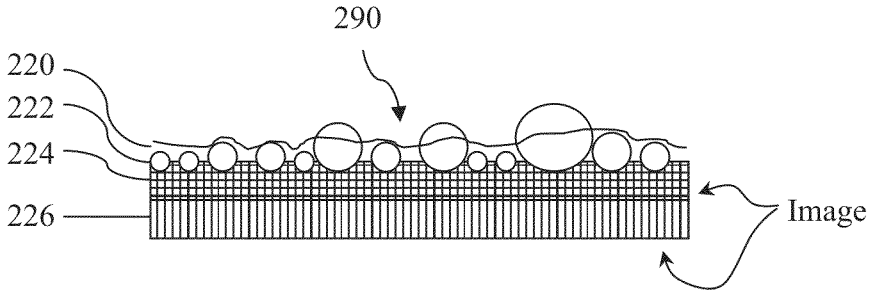
FIG. 3H is an illustration of another flexible jacket according to an embodiment of the disclosure.

Another embodiment of a flexible jacket 290 is illustrated in FIG. 3H. This embodiment may be similar to any of the embodiments illustrated in FIGS. 2A-3F except that the backing sheet 232 may not be present, and only the optional coating layer 220, the bead layer 222, the first bonding layer 224, and the film sheet 226 may be present. In this embodiment, the image may be disposed on either surface of the film sheet 226 as described above. For example, a primer layer or other coating may be used to allow the image to be disposed on the film sheet. When the image is disposed on the back side of the film sheet (e.g., the side furthest away from the bead layer 220), an optional coating may be used to prevent damage to the image. As noted above, the image may be disposed on the bead layer 222 in some embodiments. The flexible jacket 290 can be used alone to provide a relatively thin jacket or a packing layer can be used on a transfer cylinder to provide a desired space out on the transfer cylinder itself.

Figure 4A:
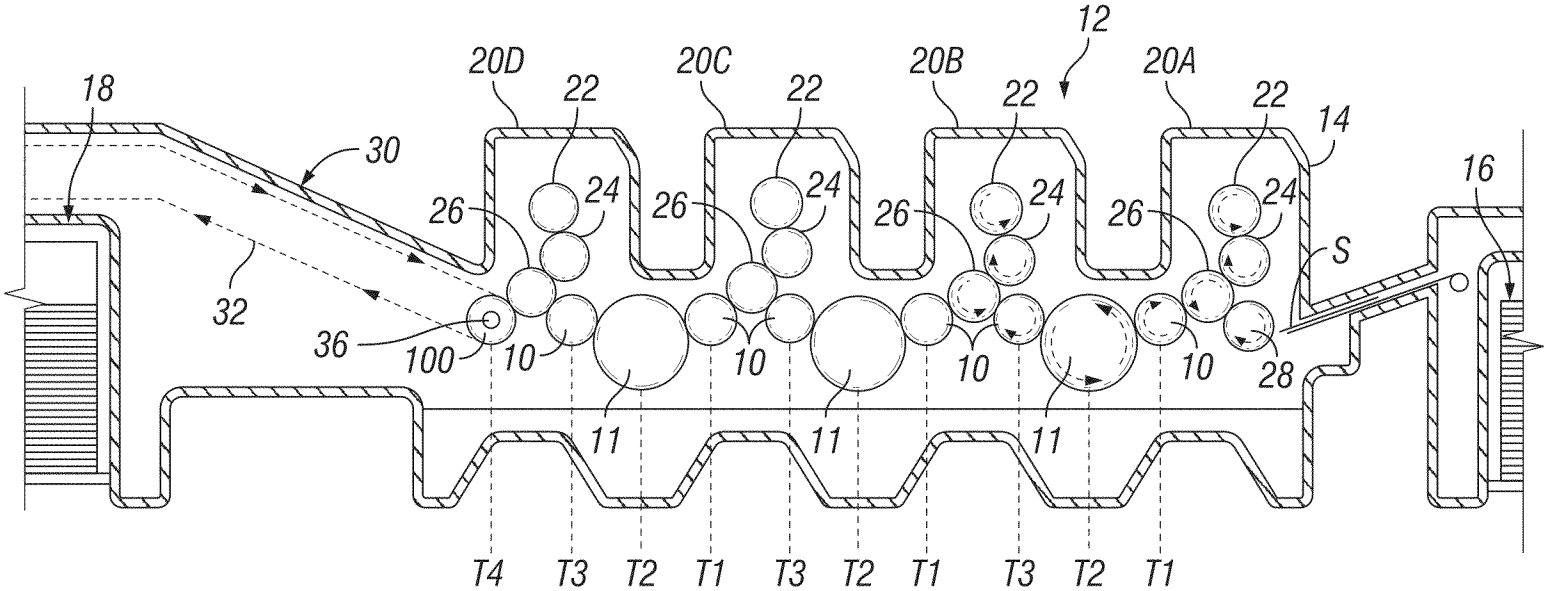
FIG. 4A is a schematic side elevational view showing multiple transfer cylinders installed at substrate transfer positions in a four color rotary offset printing press of a type made by Heidelberg Druckmaschinen Aktiengesellschaft.
Figure 4B:
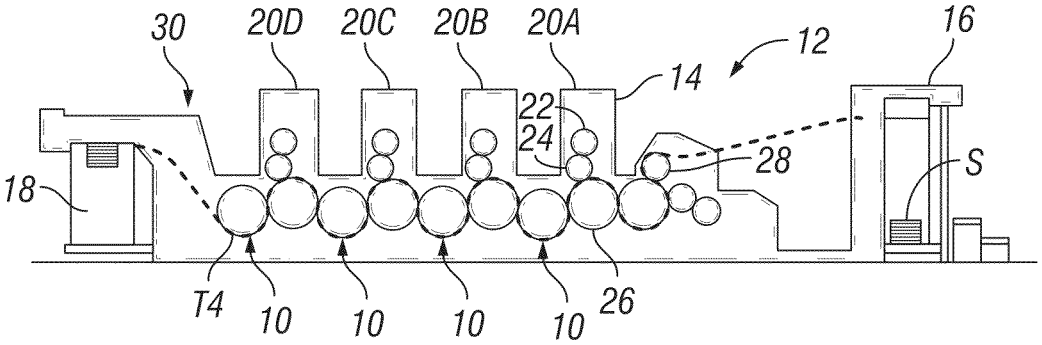
FIG. 4B is a schematic side elevational view showing multiple transfer cylinders installed at substrate transfer positions in a four color rotary offset printing press of the Lithrone Series made by Komori Corp.

For exemplary purposes, a flexible jacket 100 will be described with reference to the processing of sheet substrates. However, it will be understood that the principles of the disclosure are equally applicable to web substrates. The flexible jacket 100 may be implemented as any one of the flexible jackets described herein. The flexible jacket 100 of the present disclosure may be used in combination with high-speed printing press equipment of the type used, for example, in offset printing. FIG. 4A shows a typical, four color offset printing press of the type made by Heidelberg Druckmaschinen Aktiengesellschaft, and FIG. 4B shows a four color offset printing press of the Lithrone Series available from Komori Corp. Referring to FIGS. 4A and 4B, such equipment includes one or more transfer cylinders 10 for handling a processed substrate, such as a freshly printed sheet between printing units and upon delivery of the printed sheet to a delivery stacker. The flexible jacket 100 of the present disclosure and the optional base cover are installed on transfer cylinders 10. As used herein, the term "processed" refers to various printing methods, which may be applied to either side or both sides of a substrate, including the application of aqueous inks, protective coatings and decorative coatings. The term "substrate" refers to sheet material or web material.

Use of the present disclosure, in combination with the transfer cylinder 10 at an interstation transfer position (T1, T3) or at a delivery position (T4) in a typical rotary offset printing press 12, is believed to be readily understandable to those skilled in the art. In any case, reference may be made to U.S. Pat. Nos. 3,791,644 and 4,402,267, which disclose details regarding the location and function of a sheet support cylinder in a typical multistation printing press. The present disclosure may, of course, be utilized with conventional printing presses having any number of printing units or stations.

Referring to FIGS. 4A and 4B, the press 12 includes a press frame 14 coupled on its input end to a sheet feeder 16 from which sheets, herein designated S, are individually and sequentially fed into the press. At its delivery end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIGS. 4A & 4B, each printing press is of conventional design, and includes a plate cylinder 22, a blanket cylinder 24, and an impression cylinder 26. Freshly printed sheets S from the impression cylinder 26 are transferred to the next printing press by a transfer cylinder 10. The initial printing unit 20A is equipped with a sheet in-feed roller 28 which feeds individual sheets one at a time from the sheet feeder 16 to the initial impression cylinder 26. In an embodiment, the transfer cylinder 10 may be painted a color that promotes discernment of negatively defined visual stripes in the optional base cover by a print operator.

The freshly printed sheets S are transferred to the sheet stacker 18 by a delivery conveyor system, generally designated 30. The delivery conveyor system 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery gripper chains 32 pull the gripper bars and sheet S away from the impression cylinder 26 and transport the freshly printed sheet S to the sheet delivery stacker 18.

Referring to FIG. 4A, an intermediate transfer cylinder 11 receives sheets printed on one side from the transfer cylinder 10 of the preceding printing unit 20. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer cylinder 10 in the delivery position T4 is not equipped with grippers, and includes instead a large longitudinal opening A, which provides clearance for passage of the chain driven delivery conveyor gripper bars. In some printing press installations, an artificial radiation source, for example an ultraviolet lamp and/or an infrared lamp, may be mounted to radiate semi-directly or directly onto the interstation transfer positions T1, T2, and T3. The artificial radiation may be employed to cure and/or set the wet ink on printed substrates as they pass through the printing press.

Figure 5:
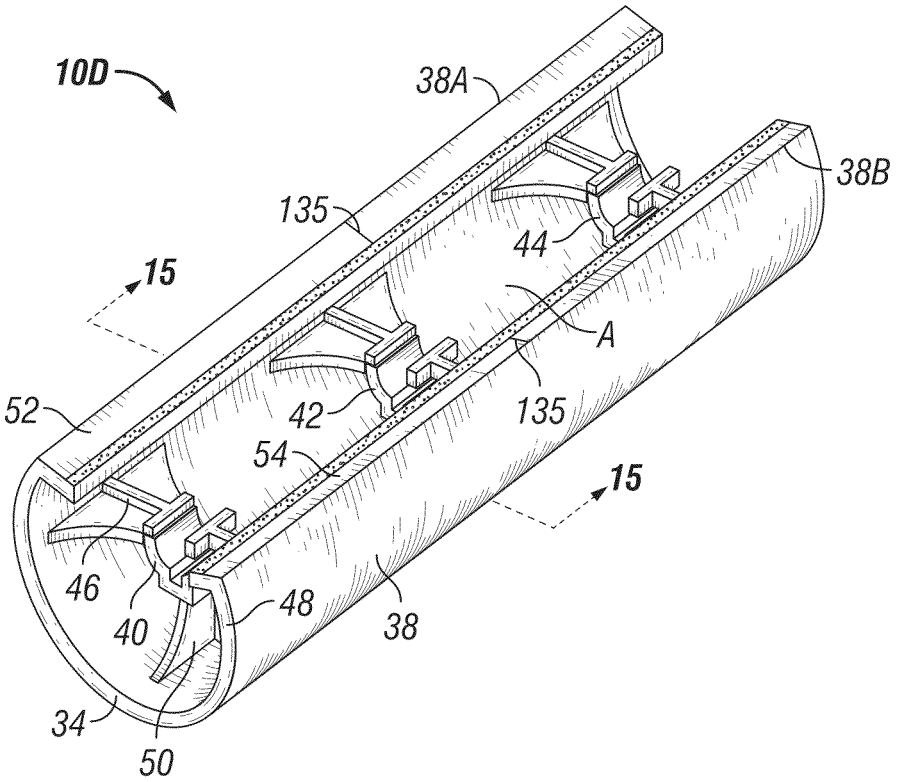
FIG. 5 is a perspective view of a transfer cylinder of a type commonly used on printing presses made by Heidelberg Druckmaschinen Aktiengesellschaft.
Figure 6A:
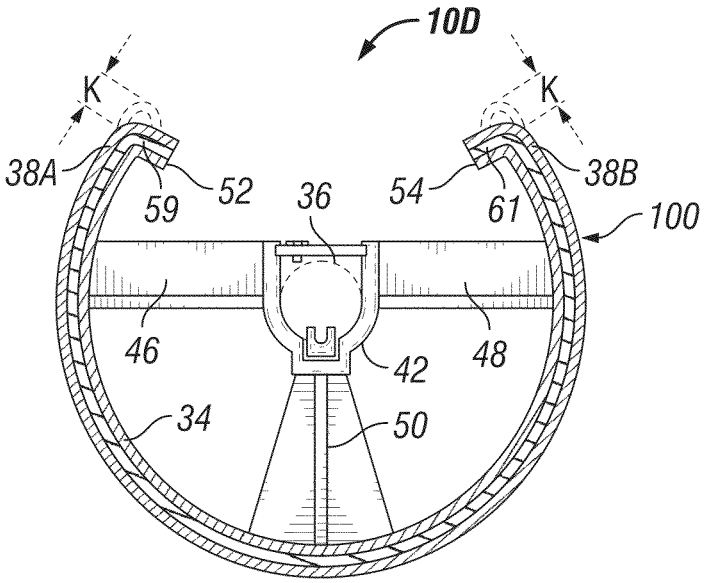
FIG. 6A is a cross-sectional view of a transfer cylinder taken along line 15-15 of FIG. 4 having an integrated, anti-marking cover installed thereon.

Referring now to FIGS. 5 and 6A, a preferred transfer cylinder 10D is shown for use with the Heidelberg printing press of FIG. 4A. The flexible jacket 100 described herein above is installed on a transfer cylinder 10D on the last printing unit 20D of the press 12 in the delivery position (T4) and has a cylindrical rim 34, which is supported for rotation on the press frame 14 by a rotatable delivery shaft 36. The external cylindrical surface 38 of the cylindrical rim 34 has a gap "A" extending longitudinally along the length of the transfer cylinder 10D and circumferentially between gripper edge 38A and tail edge 38B, respectively. The transfer cylinder 10D is attached to the delivery shaft 36 by longitudinally spaced hubs 40, 42 and 44. Additionally, center alignment marks 135 are formed on the cylinder flanges portions 52, 54 and on the external cylindrical surface 38 of the cylindrical rim 34, as shown in FIG. 5. The purpose of the center alignment marks 135 is to facilitate the precise alignment and attachment of the flexible jacket 100 and/or the optional base cover to the transfer cylinder 10D. In an embodiment, a center alignment mark 135 may also be provided on the flexible jacket 100.

The hubs 40, 42, and 44 are connected to the cylindrical rim 34 by webs 46, 48 and 50, and support the transfer cylinder 10D for rotation on the delivery shaft 36 of the printing press 12 in a manner similar to the mounting arrangement disclosed in U.S. Pat. No. 3,791,644. In the embodiment shown in FIG. 5, the delivery cylinder 10D includes opposed cylinder flanges 52, 54, which extend generally inwardly from the surface of the cylindrical rim portion 34. The flanges 52 and 54 include elongated flat surfaces for securing the flexible jacket 100 as described below. As described herein, transfer cylinders may have alternative configurations for accommodating the various means for releasably attaching the flexible jacket 100 and the optional base cover to the transfer cylinder 10 as described herein.

Figure 6B:
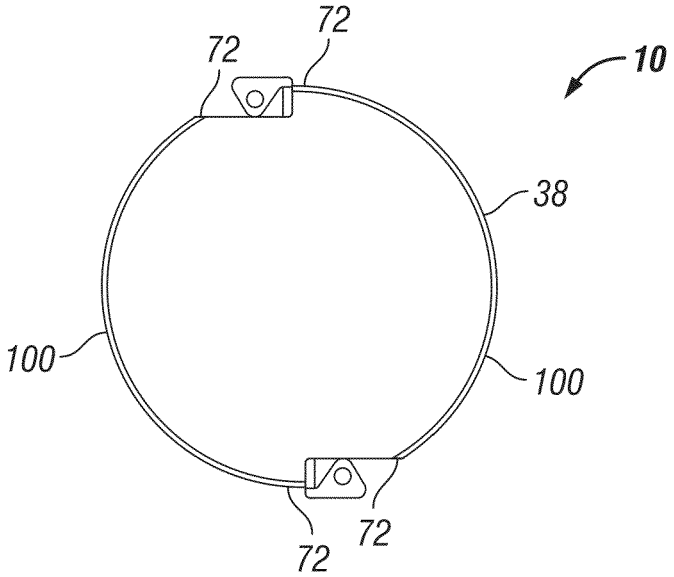
FIG. 6B is a cross-sectional view of a transfer cylinder of a type commonly used on Lithrone Series printing presses made by Komori Corp.

Referring to FIG. 6B, a cross-sectional view of preferred transfer cylinder 10 is shown for use with the Lithrone Series printing press of FIG. 4B. Transfer cylinder 10 is designed and configured to accept a pair of flexible jackets 100, with a first flexible jacket 100 covering about one-half of the cylindrical surface 38 of the transfer cylinder 10 and a second flexible jacket 100 covering about the remaining one-half of the cylindrical surface 38. The flexible jacket 100 is releasably attached to the transfer cylinder 10 at the jacket tail edge and the jacket gripper edge with flat clamp bar 72 held in place with a series of spring loaded screws spaced along the length of the clamp bar 72. In some cases, the flexible jacket 100 is attached by various means including, but not limited to, hook and loop fabric material such as VELCRO that mates adheringly to the flexible jacket 100, an adhesive strip or tape, and other adhering means. For example, the adhesive strip may be coupled on one side to the flexible jacket 100 through one of a heating process and a pressure process. In embodiment, a portion of the adhesive strip may be extruded through an edge of the flexible jacket 100 to couple the adhesive strip to the flexible jacket 100. For example, the extruded portion of the adhesive strip may form end caps or structures like rivets on the opposite side of the flexible jacket 100 to secure the adhesive strip to the flexible jacket 100. The extruded portion of the adhesive strip may partially form an interlocking matrix on the opposite side of the flexible jacket 100 to secure the adhesive strip to the flexible jacket 100. In an embodiment, a portion of the flexible jacket 100 along the edge may be abraded to provide a more suitable mating surface for coupling to a hook and loop fastener, for example VELCRO. In an embodiment, the flexible jacket 100 may be precision cut to promote simple installation, and in some embodiments, proper free play without adjustment. It is contemplated that the flexible jacket 100, taught by the present disclosure, may provide extended usage cycles relative to known designs for flexible jackets. The flexible jacket 100 may be removed, washed, and reinstalled multiple times before the flexible jacket 100 wears out.

The function and operation of the transfer cylinders 10 and associated grippers of the printing units 20 are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders 26 with the wet printed side of each sheet facing against the support surface of the transfer cylinder 10. Since each transfer cylinder 10 supports the printed sheet with the wet printed side facing against the transfer cylinder support surface, the transfer cylinder 10 is provided with the flexible jacket 100 and the optional base cover as described herein. The flexible jacket 100 and the optional base cover are releasably attached to the transfer cylinder 10 by means for releasably attaching the flexible jacket 100 and the optional base cover to a transfer cylinder 10. In an embodiment shown in FIG. 6A, the flexible jacket 100 is connected to the transfer cylinder flanges 52 and 54 by the hook and loop (i.e., VELCRO) fastener strips 59, 61. Alternatively, the flexible jacket 100 may be, at least partially, connected to the transfer cylinder 10 using adhesive strip, as described above. In an embodiment shown in FIG. 4A, the flexible jacket 100 may be attached to the transfer cylinder flanges 52 and 54 by mechanical mechanisms, for example by mechanical fasteners such as screws; mechanical take up reels or any other forms of mechanical roll up bars (often referred to collectively as reel cylinders); and the like. The flexible jacket 100 may have rods extending through loops in a gripper edge and a tail edge, and the flexible jacket 100 may attach the to the transfer cylinder 10 by snapping the rods over receiving screws at the corresponding edges of the transfer cylinder 10.

As noted above, the blanket cylinders 24 may comprise ink repellant flexible jackets or coverings similar to those described herein. The coverings may be used when a wet ink side of a sheet is being pressed against the blanket cylinder 24, for example, when the opposite side of a freshly printed image is being printed upon. The covering for the blanket cylinder 24 may comprise the image including a zoned reference that can be used to locate a potential portion of the blanket cylinder covering causing a marking problem, as described in more detail herein.

Figure 7A:
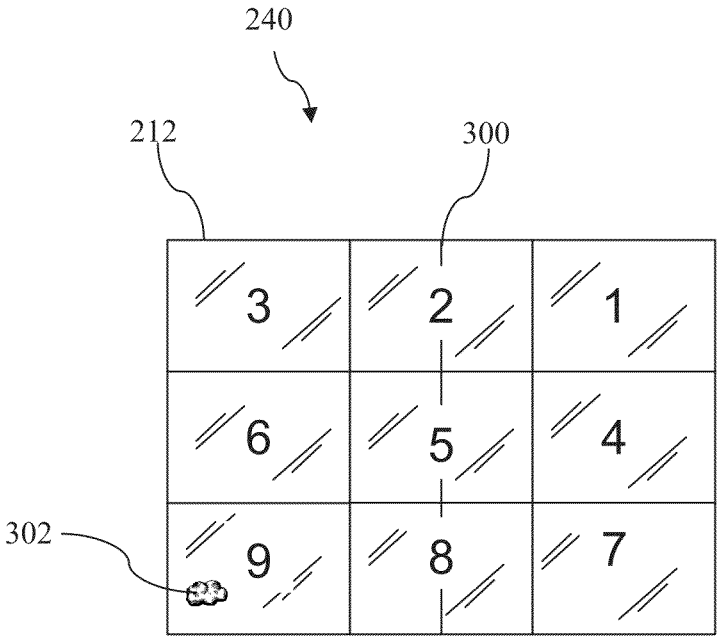
FIG. 7A is an illustration of a flexible jacket having a graphic indicating plurality of numbered areas according to an embodiment of the disclosure.
Figure 7B:
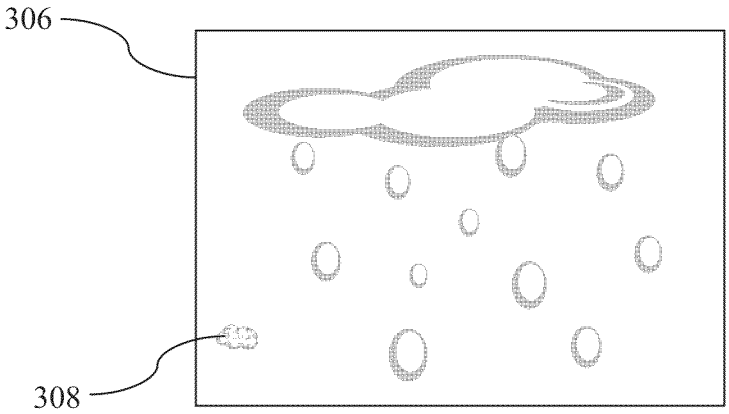
FIG. 7B is an illustration of an unprinted side of a printed substrate according to an embodiment of the disclosure.

Turning now to FIG. 7A and FIG. 7B, the flexible jacket 240 is further described in the context of a printed substrate 306. In an embodiment, the flexible jacket 240 comprises an image as described above (e.g., the flexible jacket can encapsulate a graphic, the image can be directly disposed on a layer within the flexible jacket, etc.) that indicates a plurality of areas or zones. For example, a plurality of parallel and perpendicular lines forming rectangles and area identification symbols (e.g., letters, numerals, shapes, color, etc.) may be provided as part of the flexible jacket 240 as described above. In some contexts this image may be referred to as numbered areas or numbered rectangles, though other identification symbols or references can also be used. The areas or zones may be graphically delimited or indicated in a variety of forms. The areas may be designated as abutting rectangular areas. The areas may be designated as abutting parallelograms. The areas may be designated as abutting polygons. The areas may be designated with by different graphic shapes. The graphic image indicating the numbered areas or numbered zones may be referred to as a lattice, a matrix, or a reticulation image. The cylinder may generally be between about 3 to about 12 inches in diameter, and a viewable height may be defined as the circumferential portion of the cylinder viewable from a size of the cylinder (e.g., a dimension perpendicular to the main axis of the cylinder). When viewed from the side, between about 4 to about 10 inches of the cylinder may be viewable. The zones may generally be smaller in dimension that the viewable diameter to allow a portion of the flexible jacket to be identified without having to remove it from the cylinder, and in some embodiments, the dimensions of the zones may be between about 10% and about 90% of the viewable height of the flexible jacket on the cylinder. While the zones may have different shapes, a largest dimension of the zone (e.g., a diameter, the larger of a height or width, etc.) may be in the range of between about 2 inches to about 8 inches.

While nine areas are illustrated in FIG. 7A, in other embodiments either a larger number of areas or a smaller number of areas may be indicated by the graphic 242. In an embodiment of the flexible jacket 240 that is associated with a larger transfer cylinder 10, the number of areas may be thirty-six or more. The image may be used with any of the flexible jackets described with respect to FIGS. 2A-3H. As illustrated in FIG. 7A, the gripper edge 212 of the flexible jacket 240 is at the top of FIG. 7A. The image of the flexible jacket 240 may also indicate a central axis 300 or an alignment axis of the flexible jacket 240. During use of the printing press, an ink buildup or other defect may result in the marking of subsequent substrates or sheets. The flexible jacket 240 is illustrated in FIG. 7A as having developed an ink build-up 302. FIG. 7B shows a printed substrate 306 that is facing away from the viewer, thus the printed image is ghosted to show that it is seen virtually through the unprinted side of the substrate 306. The ink build-up 302 on the flexible jacket 240 has imprinted an undesirable mark 308 on the substrate 306.

Figure 8A:
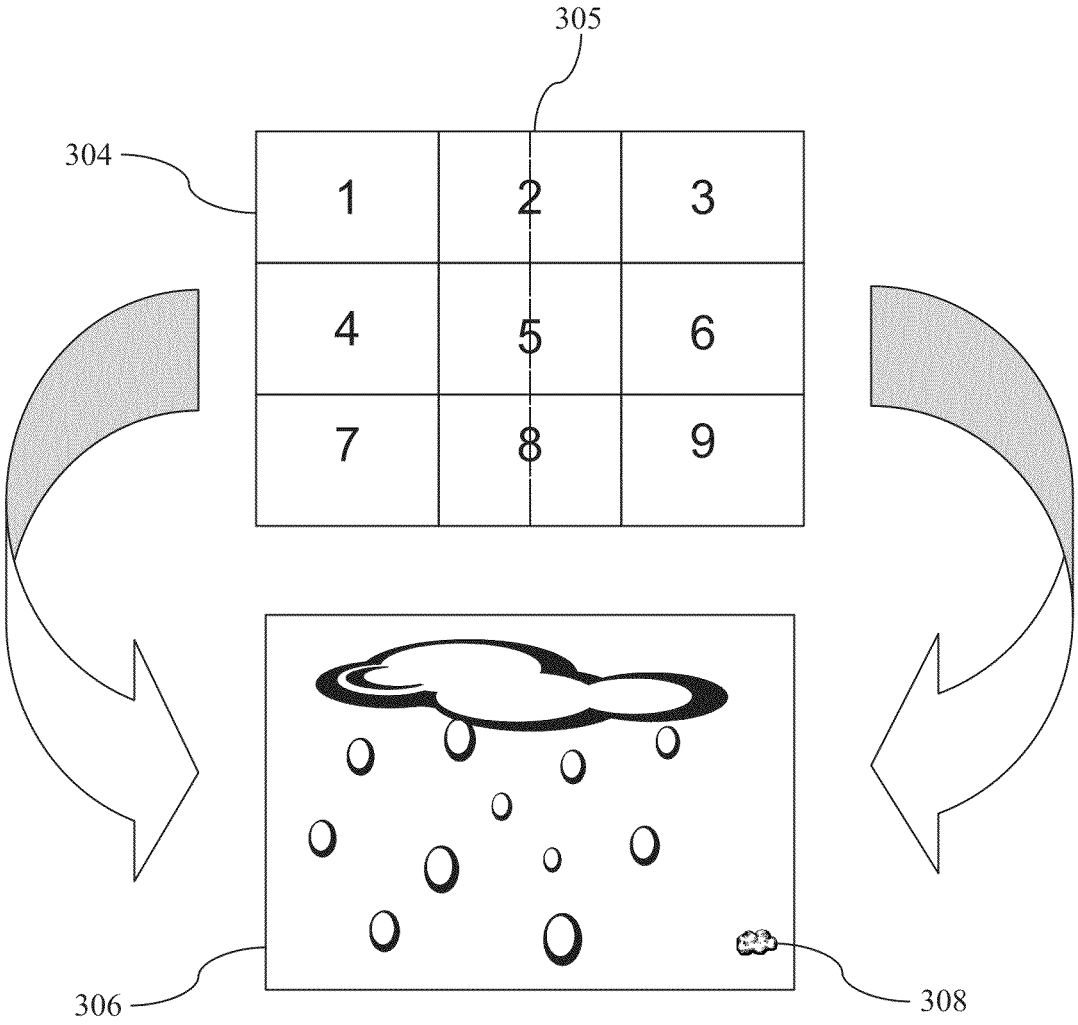
FIG. 8A is an illustration of a see through lattice and a printed side of a printed substrate according to an embodiment of the disclosure.
Figure 8B:
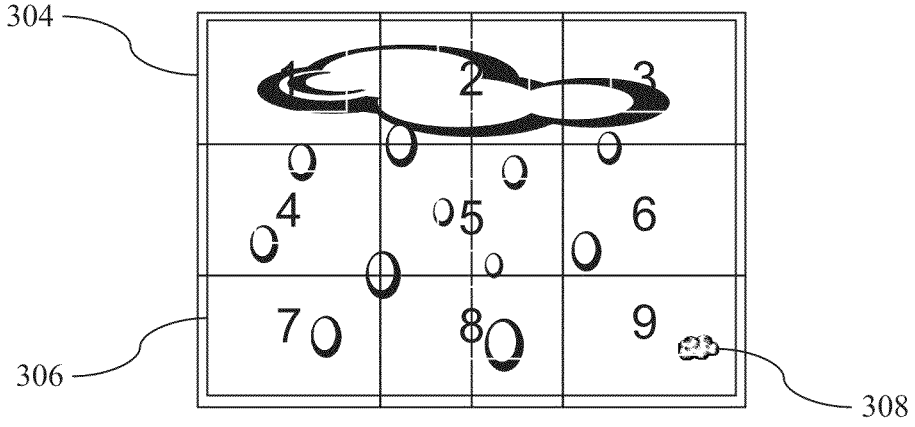
FIG. 8B is an illustration of a see through lattice positioned over a printed side of a printed substrate according to an embodiment of the disclosure.

Turning now to FIG. 8A and FIG. 8B, a see through lattice 304 is described. In some contexts the lattice 304 may be referred to as an inspection lattice. FIG. 8A shows printed substrate 306 printed side up. Note that the image on the printed substrate 306 in FIG. 8A is the mirror image of the image seen through the printed substrate 306 in FIG. 7B. Note also the position of the mark 304. The see through lattice 304 may be formed of any transparent of translucent material, for example Mylar. The lattice 304 is printed with rectangles enclosing numerals that associate to those of the graphic 242 of the flexible jacket illustrated in FIG. 7A, with the difference that the positions of the numerals are reflected about the central axis. The numbers in the rectangles are reflected about the central axis, in comparison to the location of the numbers in the rectangles on the graphic 242 shown in FIG. 7A, to take account of the turning over of the printed substrate 306. The lattice 304 may further be printed with a central axis 305 for use in aligning with the printed substrate 306. In general, the image comprising the zones is sized to match the shapes of the image on the flexible jacket 240. In FIG. 8B, the lattice 304 is illustrated positioned over the printed substrate 306. With the lattice 304 positioned over the printed substrate 306, it can readily be determined that the mark 308 is associated with zone number 9. The press operator can stop imprinting marks 308 on other printed substrates by cleaning area number 9 of the flexible jacket 240.

Figure 9A:
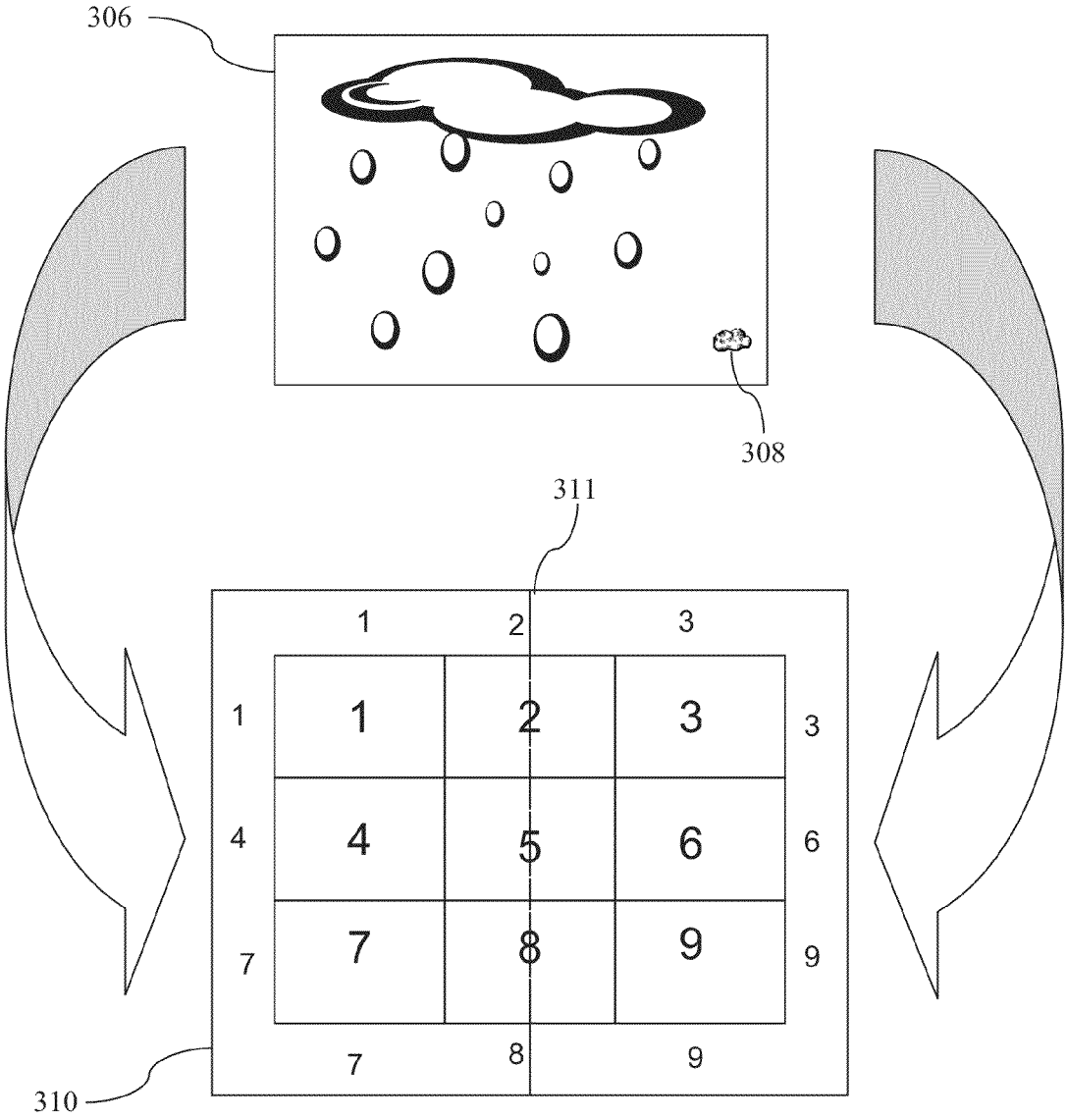
FIG. 9A is an illustration of an underlay lattice and a printed side of a printed substrate according to an embodiment of the disclosure.
Figure 9B:
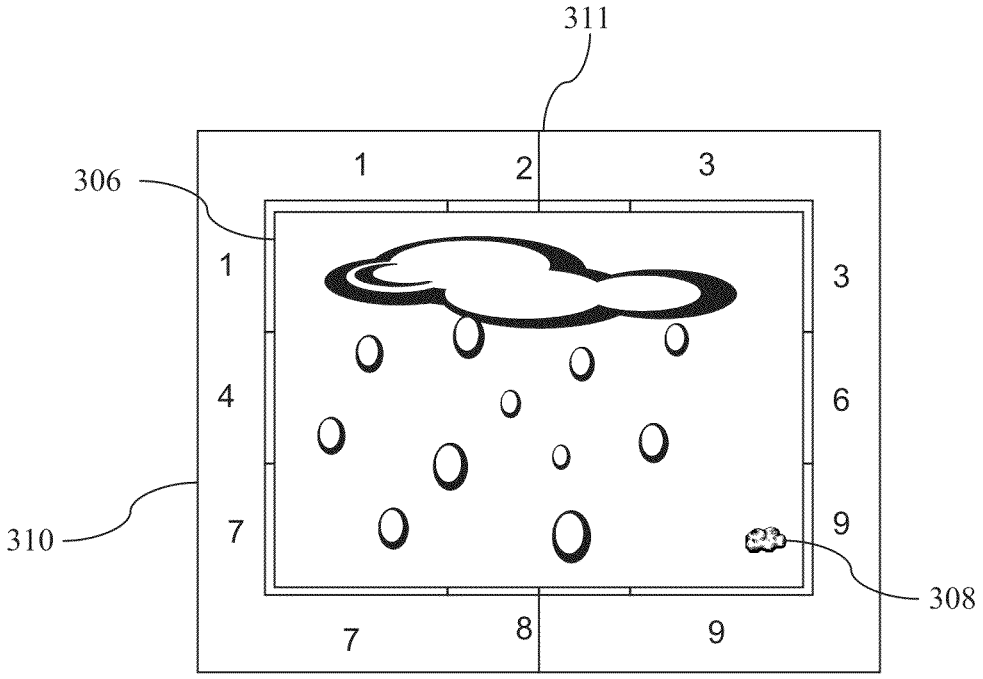
FIG. 9B is an illustration of an underlay lattice partially covered by a printed side of a printed substrate according to an embodiment of the disclosure.

By concentrating the effort to clean the flexible jacket 240 where the ink build-up 302 is located, the down-time of the press 12 may be reduced and more efficient printing may be achieved. For example, rather than cleaning the whole of the flexible jacket 240, the cleaning effort may be localized to only about $1/9^{th}$ of the flexible jacket 240. In a flexible jacket 240 that may have thirty-six areas, the cleaning effort may be localized to only about $1/36^{th}$ of the flexible jacket 240. In an embodiment, the flexible jacket may be cleaned with a solvent. In some embodiments, a solvent free cleaning process may be used to clean a zone, as described in more detail with respect to FIG. 11. Turning now to FIG. 9A and FIG. 9B, an underlay lattice 310 is described. The underlay lattice 310 may be adhered to or positioned on top of an inspection table and/or an operations stand. During a printing run, printed substrates 306 may be examined to determine if the image and/or text printed on the printed substrates 306 meets various criteria. The underlay lattice 310 comprises a lattice designating the areas and their identifying numerals. The underlay lattice 310 may further comprise a center axis line 311. As shown in FIG. 9B, the printed substrate 306 may be placed over the underlay lattice 310, and the mark 308 may readily be determined to associate to area 9 of the flexible jacket 240. In some cases, the press operator may hold the printed substrate 306 aligned with the center axis line 311 while turning up or fanning up the edge of the printed substrate 306 to see the lattice lines under the printed substrate 306 and better associate a numbered area to the mark 308 or another mark on the printed substrate 306.

Figure 10:
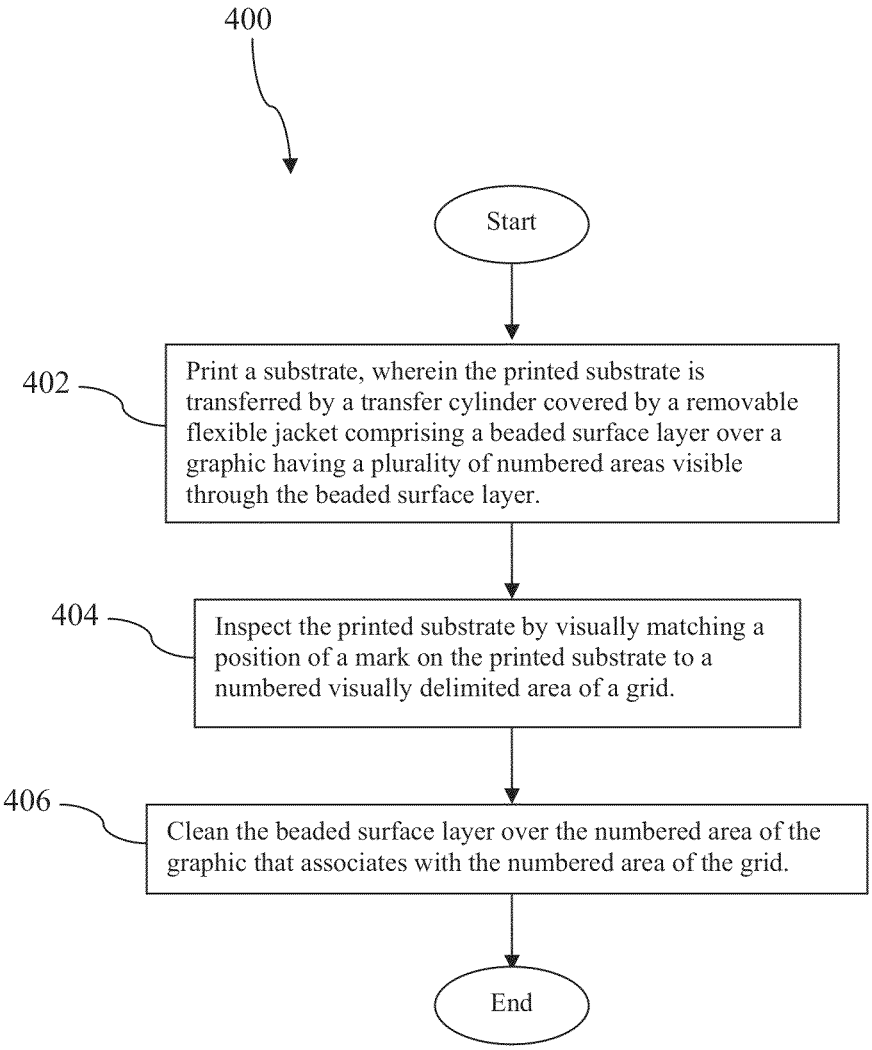
FIG. 10 is a flow chart of a method according to an embodiment of the disclosure.

Turning now to FIG. 10, a method 400 for printing is described. At block 402, a substrate is printed and transferred by the transfer cylinder 10 covered by a flexible jacket that comprises a beaded surface layer over a graphic having a plurality of numbered areas visible from the top of the flexible jacket. The flexible jacket can be any of those flexible jackets described herein that include the image. In an embodiment, the flexible jacket encapsulates the graphic between at least two barrier layers. In some embodiments, the flexible jacket may comprise the film sheet 226, the graphic 262, the first bonding layer 224, the bead layer 222, and the coating layer 220 without the backing sheet 232, without the barrier layer 230, and without the second bonding layer 228. For example, the flexible jacket may be embodied as a beaded film sheet with the image, as described above with respect to FIG. 3H.

At block 404, the printed substrate is inspected by visually matching a position of a mark on the printed substrate, for example the mark 308 on the printed substrate 306, to a numbered visually delimited area of a lattice. In an embodiment, the lattice may comprise the see through lattice 304 or the underlay lattice 310. The matching of the position of the mark 308 on the printed substrate 306 to a numbered visually delimited area of the lattice is described above with reference to FIG. 8B and FIG. 9B.

When multiple cylinders are present in the printing press (e.g., transfer cylinders with flexible jackets, blanket cylinders, etc.) the marking may correspond to a specific zone on any of the flexible jackets disposed on the cylinders. In this instance, a pressman may be able to identify the specific cylinder or section of the printing press responsible for the marking. For example, a yellow marking may indicate that the cause of the marking is in the yellow printing section of the printing press. Further information may allow the pressman to identify the appropriate cylinder to clean while the zone system may allow the appropriate portion of the flexible jacket to clean. In this way, the portion of the flexible jacket on the corresponding cylinder can be quickly and easily identified to reduce the downtime associated with cleaning a flexible jacket on the cylinder.

At block 406, the surface of the flexible jacket over the numbered area of the image that associates with the numbered area of the lattice is cleaned. This may include a single zone or a plurality of zones. This may allow the flexible jacket to be cleaned to prevent markings while allowing for less than the entire flexible jacket to be cleaned. For example, having identified the mark 308 with area 9 of the lattice, clean corresponding area 9 of the flexible jacket. The corresponding area can be cleaned with a solvent, or in some embodiments, with a solvent free cleaner. The use of a solvent free cleaner may limit the number of printed sheets that are lost due to stopping the press and cleaning the cylinder.

Figure 11:
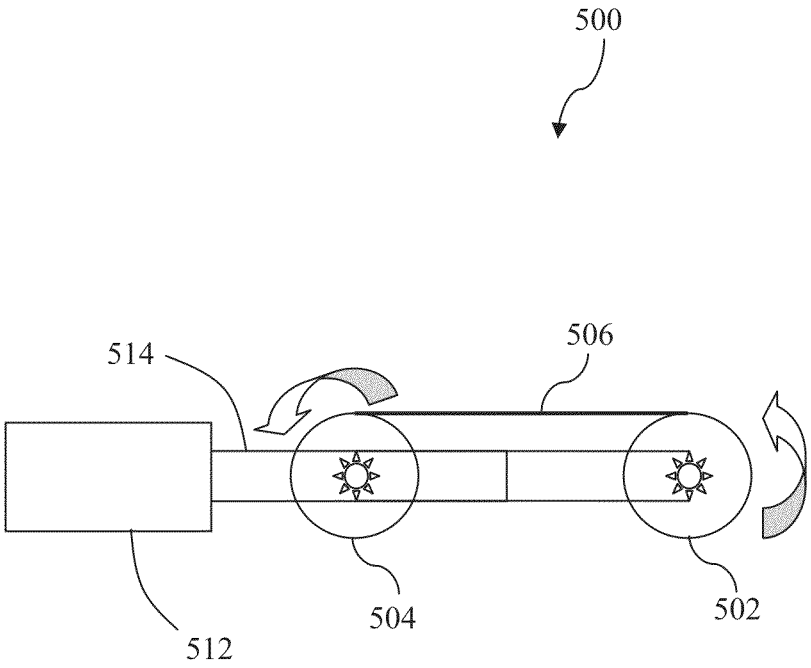
FIG. 11 is a side view of a cleaning mechanism according to an embodiment.

Turning now to FIG. 11, a flexible jacket cleaning mechanism 500 is described. In an embodiment, the mechanism 500 comprises a feed cylinder 502 storing a continuous tape of adhesive material 506 and a take-up cylinder 504 that recovers and stores the continuous tape 506 after it has been applied to clean a flexible jacket. A handle 512 may be coupled to the frame 514 that retains the feed cylinder 502 and the take-up cylinder 504. In an embodiment, the continuous tape of adhesive material 506 and the take-up cylinder 504 are approximately the same size as or narrower than a zone used in the image. In an embodiment, the adhesive material 506 may be between about one inch to about eight inches or between about 2 inches and about six inches wide. The continuous tape 506 is contained on a roll that may vary in length. For example, the roll of adhesive material may be between about two to about three hundred feet in length. In some contexts, the feed cylinder 502 may alternatively be referred to as a pay-out roll and/or pay-out cylinder. The continuous tape 506 may be scored and/or perforated at periodic intervals to promote removal of used portions of the continuous tape 506, for example portions of the continuous tape 506 that have accumulated removed ink or other surfactants, to expose adhesive portions. The scoring and/or perforating may be placed at distances corresponding to the circumference of the continuous tape 506 at that place in the roll. It is understood that the circumference of the continuous tape 506 will vary as the diameter of the continuous tape 506 varies, for example going inwards into the roll.

In an embodiment, one of the take-up cylinder 504 or feed cylinder 502 may contact the flexible jacket in the area to be cleaned with the adhesive surface of the continuous tape 506. The feed cylinder 502 and/or the take-up cylinder 504 may have a friction device that resists rotation of the roll, thereby allowing a force to be applied to the flexible jacket and the roll to be unrolled without an excessive amount of the adhesive material spooling off the roll. In an embodiment, the flexible jacket associated with the marking, for example as identified using the image and corresponding lattice key, is contacted by continuous tape 506 to clean the flexible jacket without the use of a solvent or fluid. In an embodiment, the flexible jacket associated with excess marking material is contacted by the continuous tape 506 to clean the flexible jacket using water but no other solvent. The continuous tape 506 that has contacted the flexible jacket is taken up on a take-up roller 504 and then disposed.

This flexible jacket cleaning mechanism 500 may replace existing flexible jacket cleaning mechanisms that rely upon spraying solvent over a consumable fabric which engages and cleans the flexible jacket. The solvent of the known flexible jacket cleaning mechanisms must be replenished periodically and the solvent treated consumable fabric must be properly disposed of. The solvent dispensing jets may be subject to clogging and may need to be periodically maintained by the press operator. The solvent may be subject to handling under hazardous materials processing regulations. Failures of the known flexible jacket cleaning mechanisms may result in solvent spills and/or damage to the press. The new flexible jacket mechanism 500 disclosed herein may eliminate many of these hazards and maintenance activities. Additionally, the known solvent and consumable fabric flexible jacket cleaning mechanism may not efficiently of effectively clean dried ink from the flexible jacket, but the flexible jacket cleaning mechanism 500 using the continuous adhesive tape is able to remove dried ink from the flexible jacket. While the flexible jacket cleaning mechanism 500 is described above specifically with reference to cleaning flexible jacket, the present disclosure contemplates using a similar mechanism and/or structure for engaging with and cleaning other cylinders, for example for cleaning one or more of a transfer cylinder, a delivery cylinder, an impression cylinder, a printing plate installed on a cylinder, and other cylinders of the printing press, either with the introduction of water as a solvent or without introduction of water as a solvent.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What we claim is:

1. A method of printing substrates, comprising:

printing a substrate, wherein the printed substrate is transferred by a transfer cylinder covered by a removable flexible jacket comprising an image having a first plurality of zones;

aligning a lattice with the printed substrate, wherein the lattice comprises a second plurality of zones corresponding to the first plurality of zones of the image of the removable flexible jacket;

matching a position of a mark on the printed substrate to a first zone of the second plurality of zones of the lattice, wherein the first zone corresponds to a second zone of the first plurality of zones of the image of the removable flexible jacket; and cleaning a surface layer of the removable flexible jacket over the second zone of the removable flexible jacket.

2. The method of claim 1, wherein the lattice comprises one of a transparent or translucent overlay having the second plurality of zones.

3. The method of claim 2, wherein matching the position of the mark on the printed substrate comprises overlying the lattice on top of the printed substrate.

4. The method of claim 1, wherein the lattice comprises an opaque printed substrate having symbols demarking the second plurality of zones printed outside of the area of an areas of the second plurality of zones.

5. The method of claim 4, wherein matching the position of the mark on the printed substrate comprises overlaying the printed substrate on top of the lattice.

6. The method of claim 1, wherein cleaning the surface layer over the second zone comprises cleaning the beaded surface layer over the second zone without a solvent.

7. The method of claim 1, wherein the removable flexible jacket comprises:

a film sheet; and a coating layer, wherein the image is coupled to the film sheet, wherein the image is visible through the coating layer, and wherein the image divides at least a portion of the film sheet into the first plurality of zones.

8. The method of claim 7, wherein the removable flexible jacket further comprises a sheet of woven fabric, wherein the image is disposed between the film sheet and the sheet of woven fabric.

9. The method of claim 8, wherein the sheet of woven fabric is a canvas-type fabric.

10. The method of claim 7, wherein the image is disposed on a graphic layer, and wherein the graphic layer is coupled to the film sheet.

11. The method of claim 7, wherein the image is disposed on an inner surface of the film sheet.

12. The method of claim 7, wherein the removable flexible jacket further comprises a beaded layer, wherein the beaded layer is disposed between the film sheet and the coating layer.

13. The method of claim 1, wherein the removable flexible jacket comprises:

a first barrier layer, wherein the first barrier layer is resistant to volatile organic compounds (VOC); and a second barrier layer, wherein the image is disposed between the first barrier layer and the second barrier layer, wherein the image is visible through the second barrier layer, and wherein the image divides at least a portion of the first barrier layer into the first plurality of zones.

14. The method of claim 13, wherein the image comprises a registration graphic, and wherein the method further comprises: identifying a build-up of ink on the surface layer using the registration graphic.

15. The method of claim 13, wherein the image comprises a registration graphic, and wherein the method further comprises: identifying a motion of the transfer cylinder using a movement of the registration graphic.

16. The method of claim 13, wherein the second barrier layer comprises a film sheet coupled to a beaded surface layer.

17. The method of claim 16, wherein the image is printed on the beaded surface layer.

18. The method of claim 17, wherein the removable flexible jacket further comprises a coating at least partially covering the beaded surface layer, wherein the beaded surface layer comprises beads, and wherein a cusp of at least some of the beads in the beaded surface layer are substantially free of the coating.

* * * * *